US009858897B2

(12) United States Patent
Han et al.

(10) Patent No.: US 9,858,897 B2
(45) Date of Patent: Jan. 2, 2018

(54) DISPLAY DRIVER INTEGRATED CIRCUIT INCLUDING A PLURALITY OF TIMING CONTROLLER-EMBEDDED DRIVERS FOR DRIVING A PLURALITY OF DISPLAY REGIONS IN SYNCHRONIZATION AND A DISPLAY DEVICE INCLUDING THE SAME

(71) Applicants: Dong-Heon Han, Suwon-si (KR); Choong-Bin Kim, Seoul (KR); Kyoung-Hwan Kwon, Seoul (KR); Hyun-Sang Park, Seongnam-si (KR)

(72) Inventors: Dong-Heon Han, Suwon-si (KR); Choong-Bin Kim, Seoul (KR); Kyoung-Hwan Kwon, Seoul (KR); Hyun-Sang Park, Seongnam-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 22 days.

(21) Appl. No.: 14/955,658

(22) Filed: Dec. 1, 2015

(65) Prior Publication Data

US 2016/0155421 A1 Jun. 2, 2016

(30) Foreign Application Priority Data

Dec. 1, 2014 (KR) ..... 10-2014-0169682

(51) Int. Cl.
*G09G 3/36* (2006.01)
*G09G 5/12* (2006.01)
(Continued)

(52) U.S. Cl.
CPC ..... *G09G 5/12* (2013.01); *G09G 5/006* (2013.01); *G09G 5/18* (2013.01); *G09G 3/2088* (2013.01); *G09G 3/3258* (2013.01); *G09G 3/3666* (2013.01); *G09G 2310/0264* (2013.01); *G09G 2310/0278* (2013.01); *G09G 2310/08* (2013.01); *G09G 2330/022* (2013.01)

(58) Field of Classification Search
CPC ..... G09G 3/2088; G09G 3/3666; G09G 5/12; G09G 5/006; G09G 5/18; G09G 2/3258
USPC ..... 345/103
See application file for complete search history.

(56) References Cited

U.S. PATENT DOCUMENTS 8,264,479 B2 9/2012 Chen
8,502,927 B2 8/2013 Chen et al.
(Continued)

FOREIGN PATENT DOCUMENTS

JP 2001228827 A 8/2001
JP 2006133673 A 5/2006
(Continued)

*Primary Examiner* — Adam J Snyder
(74) *Attorney, Agent, or Firm* — Harness, Dickey & Pierce, P.L.C.

(57) ABSTRACT

A display device includes at least one display panel and a display driver integrated circuit (DDI). The at least one display panel includes a first display region and a second display region. The DDI includes a first timing controller-embedded driver (TED) and a second TED. The first TED is configured to process a first image data to provide a first display data to the first display region and the second TED is configured to process a second image data to provide a second display data to the second display region. The first TED is configured to control display timings of the first display data and the second display data.

19 Claims, 22 Drawing Sheets

(51) Int. Cl.

| | |
|---|---|
| ***G09G 5/00*** | (2006.01) |
| ***G09G 5/18*** | (2006.01) |
| *G09G 3/20* | (2006.01) |
| *G09G 3/3258* | (2016.01) |

(56) References Cited

U.S. PATENT DOCUMENTS

| | | | | |
|---|---|---|---|---|
| 8,704,805 | B2 | 4/2014 | Ku | |
| 2002/0075204 | A1* | 6/2002 | Nakano | G09G 3/20 345/55 |
| 2004/0239655 | A1 | 12/2004 | Tani et al. | |
| 2007/0052857 | A1 | 3/2007 | Song et al. | |
| 2010/0171737 | A1* | 7/2010 | Bae | G09G 3/3648 345/213 |
| 2010/0302214 | A1* | 12/2010 | Kim | G09G 3/20 345/204 |
| 2011/0001768 | A1 | 1/2011 | Lin et al. | |
| 2012/0086681 | A1* | 4/2012 | Kim | G09G 3/3648 345/204 |
| 2012/0127145 | A1* | 5/2012 | Jang | G09G 3/20 345/211 |
| 2012/0162291 | A1* | 6/2012 | Kim | G09G 5/008 345/691 |
| 2012/0235964 | A1* | 9/2012 | Kim | G09G 3/20 345/204 |
| 2012/0327047 | A1 | 12/2012 | Jin et al. | |
| 2013/0038597 | A1* | 2/2013 | Kim | G09G 3/3688 345/213 |
| 2013/0044089 | A1* | 2/2013 | Chang-Chian | G06F 3/1431 345/204 |
| 2014/0118316 | A1* | 5/2014 | Ijima | G09G 3/3611 345/204 |
| 2014/0118372 | A1* | 5/2014 | Hung | G09G 3/2096 345/532 |
| 2014/0184663 | A1* | 7/2014 | Seo | G09G 3/2003 345/691 |
| 2014/0253566 | A1* | 9/2014 | Chen | G09G 3/2096 345/520 |

FOREIGN PATENT DOCUMENTS

| | | | |
|---|---|---|---|
| JP | 4102309 | B2 | 6/2008 |
| JP | 2009180989 | A | 8/2009 |
| KR | 100759981 | B1 | 9/2007 |
| KR | 101125471 | B1 | 3/2012 |
| KR | 20120133464 | A | 12/2012 |
| KR | 101337897 | B1 | 12/2013 |
| KR | 20140055524 | A | 5/2014 |

* cited by examiner

300

400

DISPLAY DRIVER INTEGRATED CIRCUIT INCLUDING A PLURALITY OF TIMING CONTROLLER-EMBEDDED DRIVERS FOR DRIVING A PLURALITY OF DISPLAY REGIONS IN SYNCHRONIZATION AND A DISPLAY DEVICE INCLUDING THE SAME

CROSS-REFERENCE TO RELATED APPLICATION

This U.S. application claims priority under 35 USC §119 to Korean Patent Application No. 10-2014-0169682, filed on Dec. 1, 2014, in the Korean Intellectual Property Office (KIPO), the disclosure of which is incorporated by reference in its entirety herein.

BACKGROUND

1. Technical Field

Example embodiments relate generally to displays, and more particularly to a display driver integrated circuit (DDI), and/or a display device including the same.

2. Discussion of the Related Art

Various planar display devices have been developed which have less volume and weight than that of a related art cathode ray tube (CRT). Such planar display devices may comprise a plasma display panel (PDP), a liquid crystal display (LCD) device, a field emission display device, an organic light emitting display device, etc.

The LCD device may display images by applying voltage to a liquid crystal injected between two glass substrates. That is, the light transmission of the liquid crystal injected between two glass substrates may be adjusted according to applied voltage. Images may be displayed according to the light transmission of the liquid crystal.

The OLED display device may display images using an OLED, which has an organic material layer, as an illuminating material, between an anode injecting holes and a cathode injecting electrons. The OLED produces its own light through recombination of electrons and holes in the organic material layer. At this time, the strength of light may be determined based upon the amount of current flowing into the OLED.

SUMMARY

Some example embodiments provide a display driving integrated circuit capable of synchronizing a plurality of display data.

Some example embodiments provide a display device including a display driving integrated circuit, capable of synchronizing a plurality of display data.

According to at least one example embodiment, a display device may include at least one display panel and a display driver integrated circuit (DDI). The at least one display panel may include a first display region and a second display region. The DDI may include a first timing controller-embedded driver (TED) and a second TED. The first TED may be configured to process a first image data to provide a first display data to the first display region and the second TED may be configured to process a second image data to provide a second display data to the second display region. The first TED may be configured to control display timings of the first display data and the second display data.

In at least one example embodiment, the first display data and the second display data may constitute a frame that may be displayed in the first display region and the second display region.

In at least one example embodiment, the first TED may transmit a line synchronization (sync) signal to the second TED such that the first display data and the second display data may be displayed in synchronization with respect to each other in the at least one display panel.

The first TED may be configured to transmit a request to the second TED when a first primary image line corresponding to a first image line of the first image data is ready. The second TED may be configured to transmit a response to the first TED that may indicate whether a first secondary image line corresponding to the first primary image line and corresponding to a first image line of the second image data is ready.

The second TED may be configured to transmit an acknowledge (ACK) signal as the response to the first TED when the first secondary image line of the second image data is ready and the second TED may be configured to display the first secondary image line in the second display region in synchronization with the line sync signal.

The second TED may be configured to transmit a negative acknowledge (NACK) signal as the response to the first TED when the first secondary image line of the second image data is not ready.

The first TED may be configured to transmit the request to the second TED when a second primary image line of the first image data, consecutive to the first primary image line, after the first TED receives the NACK signal, the second TED may be configured to transmit a response to the first TED that may indicate whether a second secondary image line of the second image data, corresponding to the second primary image line, is ready.

When the first TED receives the NACK signal from the second TED consecutively not less than a desired reference or threshold number of times, the first TED may be configured to drive a detection line connected to the second TED to a first logic level such that a first replacement image data and a second replacement image data are respectively displayed in the first display region and the second display region.

In at least one example embodiment, the first TED may be configured to transmit a frame sync signal to the second TED after the first TED transmits a last image line of the first image data to the first display region and the frame sync signal may indicate that a next frame is to be displayed.

In at least one example embodiment, the first TED may include a first reception interface, a first line memory, a first interface, a first synchronization controller, a first mode signal generator, a first timing generator, a first selection circuit, a first data driver and a first mode detector. The first reception interface may be configured to receive the first image data, a first control signal associated with the first image data and an external clock signal. The first line memory may be configured to receive the first image data from the first reception interface and may be configured to store the first image data on an image line basis. The first interface may be connected to the first line memory. The first interface may be configured to transmit a request to the second TED when a first primary image line corresponding to a first image line of the first image data is stored in the first line memory and the first interface may be configured to receive a response to the request from the second TED. The first synchronization controller may be configured to receive an acknowledge (ACK) signal as the response from the second TED and may be configured to transmit the line sync signal to the second TED in response to the ACK signal. The ACK signal may indicate that a first secondary image line of the second image data is ready. The first mode signal generator may be configured to generate a first mode signal at least based on the ACK signal. The first timing generator may be configured to generate a first data control signal, a first gate control signal and a first replacement image data based on the external clock signal, the first control signal and the first mode signal. The first selection circuit may be configured to select one of the first replacement image data and an output of the first line memory in response to the first mode signal. The first data driver may be configured to provide an output of the first selection circuit as the first display data to the first display region in response to the first data control signal. The first mode detector may be configured to drive a detection line connected to the second TED to a first logic level when the first mode signal is a second logic level and may be configured to provide a first fail flag signal to the first mode signal generator in response to detecting the detection line driven to the first logic level.

The first timing generator may be configured to include a clock generator, a signal generator and a register. The clock generator may be configured to generate an internal clock signal in response to the external clock signal. The signal generator may be configured to generate the first data control signal and the first gate control signal in response to the first control signal. The register may be configured to output a stored image data therein as the first replacement image data in response to the first mode signal and the internal clock signal.

The first mode signal generator may be configured to output the first mode signal with a first logic level when the first mode signal generator receives the ACK signal, may be configured to output the first mode signal with a second logic level when the first mode signal generator receives a negative acknowledge (NACK) signal indicating that an image line of the second image data from the first interface consecutively not less than a desired reference or threshold number of times and may be configured to output the first mode signal with a first logic level in response to the first fail flag signal.

The selection circuit may be configured to select the output of the first line memory to be provided out to the first data driver in response to the first mode signal with a first logic level. The selection circuit may be configured to select the first replacement image data to be provided out to the first data driver in response to the first mode signal with a second logic level.

The second TED may include a second reception interface, a second line memory, a second interface, a second synchronization controller, a second mode signal generator, a second timing generator, a second selection circuit, a second data driver and a second mode detector. The second reception interface may be configured to receive the second image data, a second control signal associated with the second image data and the external clock signal. The second line memory may be configured to receive the second image data from the second reception interface and configured to store the second image data on an image line basis. The second interface may be connected to the second line memory. The second interface may be configured to transmit the response to the first TED and the response indicates whether a first secondary image line corresponding to a first image line of the second image data is ready. The second synchronization controller may be configured to receive the line sync signal from the first TED. The second mode signal generator may be configured to generate a second mode signal based on the ACK signal and the line sync signal. The second timing generator may be configured to generate a second data control signal, a second gate control signal and a second replacement image data based on the external clock signal, the second control signal and the second mode signal. The second selection circuit may be configured to select one of the second replacement image data and an output of the second line memory in response to the second mode signal. The second data driver may be configured to provide an output of the second selection circuit as the second display data to the second display region in response to the second data control signal. The second mode detector may be configured to drive the detection line connected to the first TED to a first logic level when the second mode signal is a second logic level and may be configured to provide a second fail flag signal to the second mode signal generator in response to detecting the detection line driven to the first logic level.

The first interface and the second interface may be implemented with one of a serial peripheral interface (SPI) and an inter-integrated circuit (I2C) interface. The second mode signal generator may be configured to output the second mode signal with a first logic level in response to the line sync signal and the ACK signal and may be configured to output the second mode signal with a second logic level in response to the second fail flag signal. The second synchronization controller may be configured to transmit to the first TED a line ready signal indicating that the second replacement image signal is ready when the second mode signal has a second logic level. The first synchronization controller may be configured to transmit the line sync signal to the second TED in response to the line ready signal such that the first replacement image data and the second replacement image data are respectively displayed in the first display region and the second display region in synchronization with respect to each other.

In at least one example embodiment, the at least one display panel may include a display panel that is divided into the first display region and the second display region. The display panel may include a plurality of pixels connected to the DDI through a plurality of data lines and a plurality of scan lines. Each of the pixels may include one of liquid crystal and an organic light-emitting diode (OLED).

In at least one example embodiment, the at least one display panel may include a first display panel having the first display region and a second display panel having the second display region. Each of the first display panel and the second display panel may include a plurality of pixels connected to the DDI through a plurality of data lines and a plurality of scan lines. Each of the pixels may include one of liquid crystal and an organic light-emitting diode (OLED).

According to at least one example embodiment, a display device includes a first through fourth display regions and a display driver integrated circuit (DDI). The DDI includes first through fourth TEDs. The first TED is configured to process a first image data to provide a first display data to the first display region, the second TED is configured to process a second image data to provide a second display data to the second display region, the third TED is configured to process a third image data to provide a third display data to the third display region and the fourth TED is configured to process a fourth image data to provide a fourth display data to the fourth display region. The second TED may be configured to control display timings of the first TED, the third TED and the fourth TED.

In at least one example embodiment, the second TED may be configured to operate as a master with respect to the first TED and the third TED, and the third TED may be configured to operate as a slave with respect to the second TED and may be configured to operate as a master with respect to the fourth TED. Adjacent TEDs of the first through fourth TEDs may be configured to exchange information of corresponding image data during a vertical blank period in a frame.

In at least one example embodiment, the second TED may be configured to transmit a line synchronization (sync) signal to the first TED, the third TED and the fourth TED such that corresponding image lines of the first through fourth display data are displayed in synchronization with respect to each other in the first through fourth display regions. The second TED may be configured to transmit a first request to the first TED, may be configured to transmit a second request to the third TED and may be configured to transmit a third request to the fourth TED via the third TED when a first image line of the second image data is ready.

The first TED may be configured to transmit, to the second TED, a first acknowledge (ACK) signal indicating that a first image line of the first image data is ready when the first image line of the first image data is ready. The fourth TED may be configured to transmit a second ACK signal to the third TED when a first image line of the fourth image data is ready. The third TED may be configured to transmit a third ACK signal to the second TED when a first image line of the third image data and the third TED may be configured to receive the second ACK signal. In response to the first ACK signal and the third ACK signal, the first TED may be configured to transmit a first line sync signal to the first TED, may be configured to transmit a second line sync signal to the third TED and may be configured to transmit a third line sync signal to the fourth TED.

According to at least one example embodiment, a display driver integrated circuit (DDI) includes a plurality of timing controller-embedded drivers (TED)s. The plurality of TEDs may be configured to process a plurality of image data to provide a plurality of display data to a plurality of display regions, respectively. There may be at least one master TED of the plurality of TEDs that may be configured to operate as a master, and may be configured to control display timings of the other plurality of TEDs.

In at least one example embodiment, the at least one master TED may be configured to transmit line synchronization (sync) signal to at least one of the other plurality of TEDs such that corresponding image lines of the plurality of display data are displayed in synchronization with respect to each other in the plurality of display regions.

In at least one example embodiment, the plurality of TEDs may include a first TED and a second TED. The first TED may be configured to operate as the master TED. The second TED may be configured to operate as a slave and may display corresponding display data under control of the first TED According to at least one example embodiment, a display device may include at least one display device, the display device may include at least one display panel, at least one display driver integrated circuit (DDI), the DDI may include at least one timing controller-embedded driver (TED), the at least one TED configured to process image data, and the display device configured to display the processed image data in the at least one display panel.

In at least one example embodiment, the at least one TED may include a plurality of TEDs and each of the plurality of TEDs may be configured to process image data, and the at least one display panel may include a plurality of display regions and each of the plurality of display regions may be configured to display the processed image data associated with the plurality of TEDs In at least one example embodiment, at least one of the plurality of TEDs may be configured to manage the plurality of TEDs, and the at least one managing TED may be configured to synchronize the display timing of the processed image data such that image distortion in the at least one display panel does not occur.

In at least one example embodiment, the display timing of the processed image data may be synchronized in accordance with a signal transmitted by the at least one managing TED to the plurality of TEDs.

In at least one example embodiment, the at least one display panel may be configured to display a replacement image in the at least one display region when a failure is detected in at least one of the plurality of TEDs.

According to at least one example embodiment, a DDI includes at least a first TED and a second TED. The first TED may be configured to process a first image data to generate a first display data and the second TED may be configured to process a second image data to generate a second display data. One of the first TED and the second TED, may be configured to operate as a master, may be configured to control display timing of the first display data and the second display data such that corresponding image lines of the first and second display data are displayed in synchronization with respect to each other in at least a first display region and a second display region.

BRIEF DESCRIPTION OF THE DRAWINGS

The foregoing and other features of inventive concepts will be apparent from the more particular description of non-limiting embodiments of inventive concepts, as illustrated in the accompanying drawings in which like reference characters refer to like parts throughout the different views. The drawings are not necessarily to scale, emphasis instead being placed upon illustrating principles of inventive concepts. In the drawings.

DETAILED DESCRIPTION

Figure 1A:
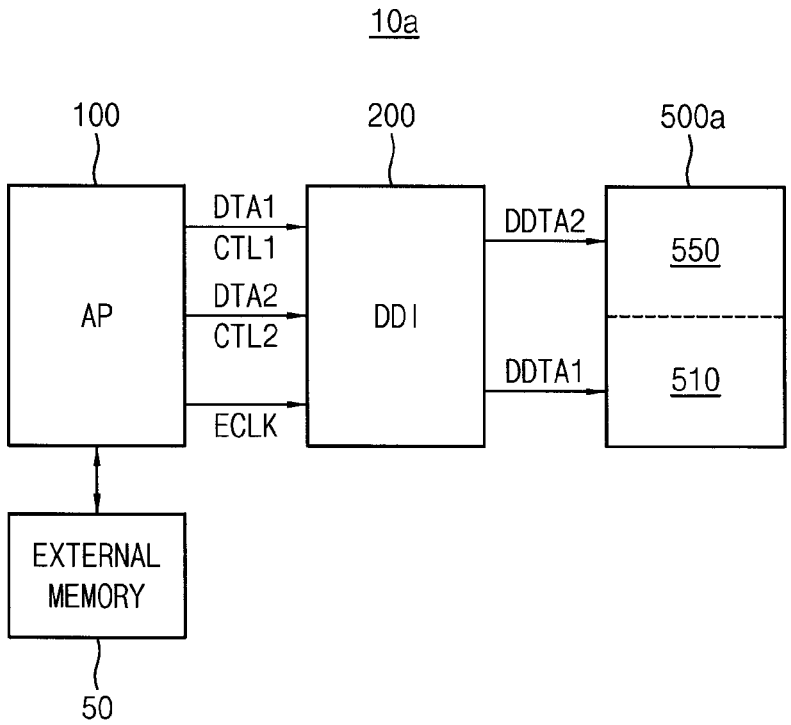
FIGS. 1A and 1B are block diagrams respectively illustrating display systems according to at least one example embodiment.

Various example embodiments will now be described more fully with reference to the accompanying drawings, in which some example embodiments are shown. Example embodiments, may, however, be embodied in many different forms and should not be construed as being limited to the embodiments set forth herein; rather, these example embodiments are provided so that this disclosure will be thorough and complete, and will fully convey the scope of example embodiments of inventive concepts to those of ordinary skill in the art. In the drawings, the thicknesses of layers and regions are exaggerated for clarity. Like reference characters and/or numerals in the drawings denote like elements, and thus their description may be omitted.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements or layers should be interpreted in a like fashion (e.g., "between" versus "directly between," "adjacent" versus "directly adjacent," "on" versus "directly on"). As used herein the term "and/or" includes any and all combinations of one or more of the associated listed items.

It will be understood that, although the terms "first", "second", etc. may be used herein to describe various elements, components, regions, layers and/or sections. These elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof. Expressions such as "at least one of," when preceding a list of elements, modify the entire list of elements and do not modify the individual elements of the list.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle may have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

In example embodiments, a nonvolatile memory may be embodied to include a three dimensional (3D) memory array. The 3D memory array may be monolithically formed on a substrate (e.g., semiconductor substrate such as silicon, or semiconductor-on-insulator substrate). The 3D memory array may include two or more physical levels of memory cells having an active area disposed above the substrate and circuitry associated with the operation of those memory cells, whether such associated circuitry is above or within such substrate. The layers of each level of the array may be directly deposited on the layers of each underlying level of the array.

In example embodiments, the 3D memory array may include vertical NAND strings that are vertically oriented such that at least one memory cell is located over another memory cell. The at least one memory cell may comprise a charge trap layer.

The following patent documents, which are hereby incorporated by reference in their entirety, describe suitable configurations for three-dimensional memory arrays, in which the three-dimensional memory array is configured as a plurality of levels, with word lines and/or bit lines shared between levels: U.S. Pat. Nos. 7,679,133; 8,553,466; 8,654,587; 8,559,235; and US Pat. Pub. No. 2011/0233648.

Figure 1B:
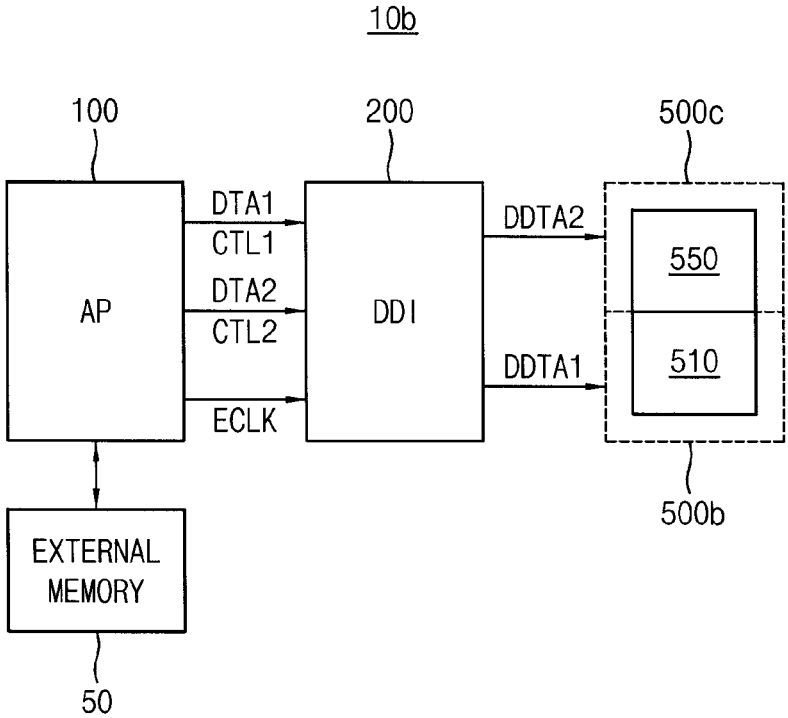

FIGS. 1A and 1B are block diagrams respectively illustrating display systems according to at least one example embodiment.

Referring to FIGS. 1A and 1B, a display system (or, an image data processing system) 10*a* or 10*b* may include an application processor 100, an external memory 50, a display driver integrated circuit (DDI) 200 and at least one display panel 500*a* or 500*b* and 500*c*.

In some example embodiments, the application processor 100 and the DDI 200 may be implemented with a module, a system-on chip, or a package, i.e., a multi-chip package. In some example embodiments, the DDI 200*a* and the at least one display panel 500*a* may be implemented with one module.

The display system 10*a* or 10*b* may be implemented by a personal computer (PC), a television, a portable device, or other electronic device that includes a display.

The portable device may include a laptop, a mobile phone, a smart phone, a tablet, a personal digital assistant (PDA), a portable multimedia player (PMP), a MP3 player, a navigation system, etc.

The application processor 100 may be configured to control the external memory 50 and/or the DDI 200. In FIG. 1A, the display panel 500*a* may include a first display region 510 and a second display region 550. In FIG. 1B, the first display panel 500*b* may include a first display region 510 and a second display panel 500*c* may include a second display region 550. The external memory 50 may be configured to store display data to be displayed in the first display region 510 and the second display region 550.

The application processor 100 may be configured to provide the DDI 200 with a first image data DTA1 and a first control signal CTL1 associated with the first image data DTA1 and may be configured to provide the DDI 200 with a second image data DTA2 and a second control signal CTL2 associated with the second image data DTA2.

The DDI 200 may be configured to process the first image data DTA1 according to the first control signal CTL1 to transmit a first display data DDTA1 to the first display region 510 and may be configured to process the second image data DTA2 according to the second control signal CTL2 to transmit a second display data DDTA2 to the second display region 550. The DDI 200 may include a first timing controller-embedded driver (TED) and a second TED. The first TED may be configured to process the first image data DTA1 and the second TED may be configured to process the second image data DTA2. The first TED may be configured to control display timings of the first display data DDTA1 and the second display data DDTA2 such that the first display data DDTA1 and the second display data DDTA2 are displayed in synchronization with respect to each other in the at least one display panel 500*a* or 500*b* and 500*c*. By displaying the display data in synchronization with respect to each other in the at least one display panel, image distortion in the displayed image may be avoided at least in part because the timing skews related to the delay in transmitting data by the TEDs through the circuit and/or variations in the internal clock of the TEDs are reduced, mitigated and/or eliminated.

Figure 2:
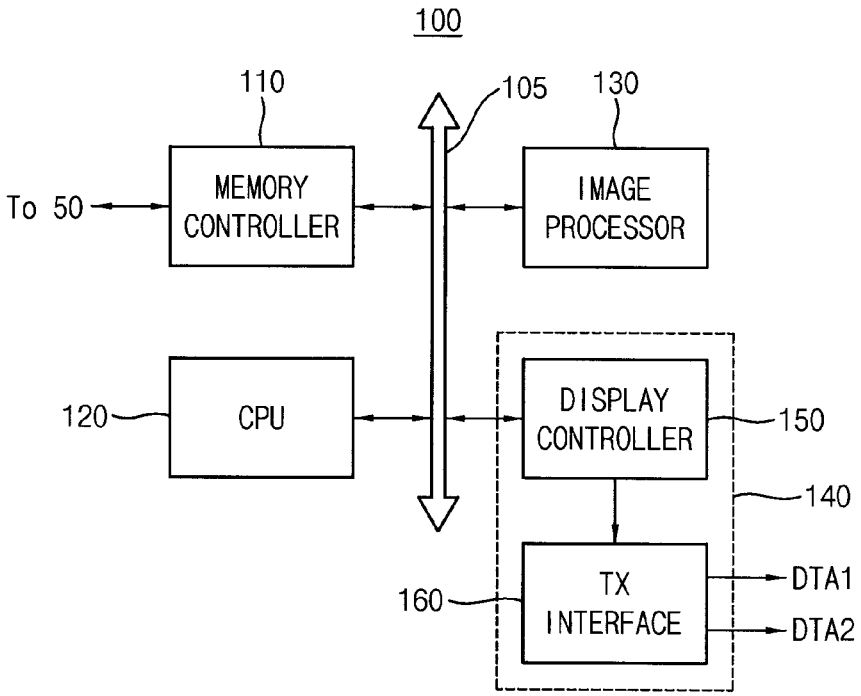
FIG. 2 is a block diagram illustrating the application processor in FIG. 1A or FIG. 1B according to at least one example embodiment.

FIG. 2 is a block diagram illustrating the application processor in FIG. 1A or FIG. 1B according to at least one example embodiment.

Referring to FIG. 2, the application processor 100 may include a memory controller 110, a central processing unit (CPU) 120, an image processor 130 and a display block 140. The display block 140 may include a display controller 150 and a transmission interface 160. The memory controller 110, the CPU 120, the image processor 130 and the display block 140 may be configured to communicate with one another through a bus 105.

The memory controller 110 may be configured to control the external memory 50.

Image data such as moving data or still data output from the external memory 50 may be transmitted to the display block 140 through the bus 105 under the control of the CPU 120. The external memory 50 may include a volatile memory such as dynamic random access memory (DRAM), etc., or a nonvolatile memory, such as a NAND flash memory, a magnetoresistance random access memory (MRAM), or the like. The CPU 120 may include a single core having one core processor or a multi-core having a plurality of core processors, or may be configured as a multi-processor system, a distributed processing system, etc.

The image processor 130 may be configured to process the image data output from the external memory 50 and store the processed image data in the external memory 50.

The display controller 150 may be configured to control the transmission interface 160 to transmit the image data stored in the external memory 50.

The transmission interface 160 may be configured to transmit the first image data DTA1 and the first control signal CTL1 associated with the first image data DTA1 and an external clock signal to the DDI 200 under control of the display controller 150. In addition, the transmission interface 160 may be configured to transmit the second image data DTA2 and the second control signal CTL2 associated with the first image data DTA2 and the external clock signal to the DDI 200 under control of the display controller 150.

Figure 3:
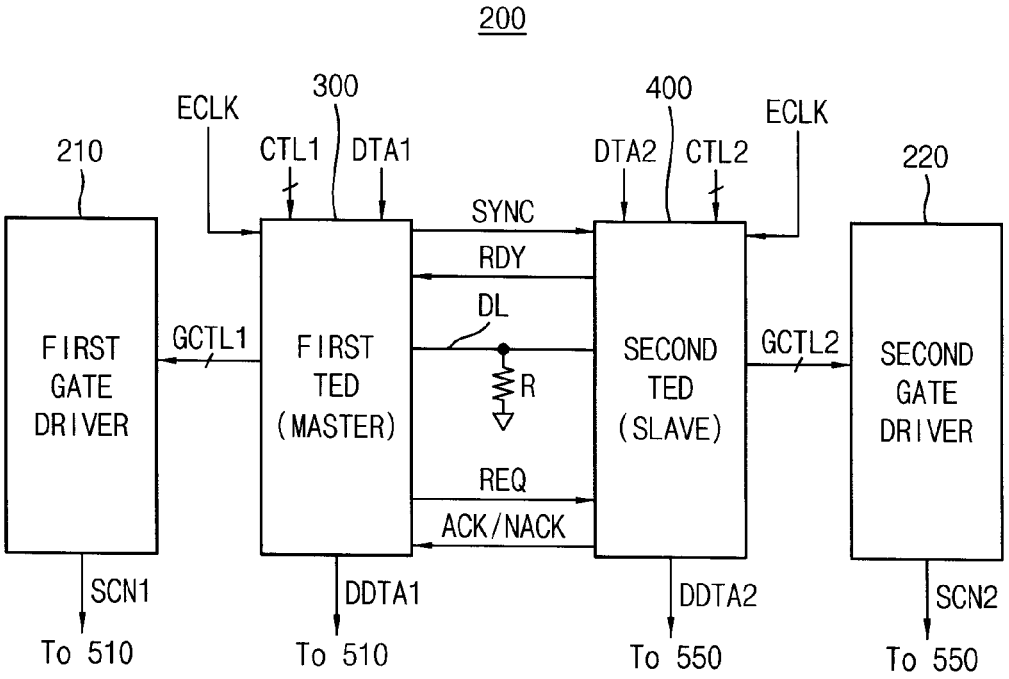
FIG. 3 is a block diagram illustrating the display driver integrated circuit (DDI) in FIG. 1A or FIG. 1B according to at least one example embodiment.

FIG. 3 is a block diagram illustrating the display driver integrated circuit (DDI) in FIG. 1A or FIG. 1B according to at least one example embodiment.

Referring to FIG. 3, the DDI 220 may include a first TED 300, a second TED 400, a first gate driver 210 and a second gate driver 220.

The first TED 300 may be configured to receive signals from the application processor 100, such as the first image data DTA1, the first control signal CTL1, the external clock signal ECLK, etc., and may be configured to provide the first gate driver 210 with a control signal, such as the first gate control signal GCTL1 for controlling the first gate driver 210. The first TED 300 may be configured to process image data, such as the first image data DTA1, and may provide display data to the first display region 510, such as the first display data DDTA1. The first gate driver 210 may be configured to sequentially drive a scan signal, such as SCN1, to scan lines in the first display region 510 in response to a gate control signal, such as the first gate control signal GCTL1.

The second TED 400 may be configured to receive signals from the application processor 100, such as the second image data DTA2, the second control signal CTL2, the external clock signal ECLK, etc., and may be configured to provide the second gate driver 220 with a control signal for controlling the second gate driver 220, such as second gate control signal GCTL2. The second TED 400 may be configured to process image data, such as the second image data DTA2, and to provide display data, such as DDTA2, to the second display region 550. The second gate driver 220 may be configured to sequentially drive a scan signals, such as SCN2, to scan lines in the second display region 550 in response to a gate control signal, such as GCTL2.

When the first TED 300 processes the first image data DTA1 to provide the first display data DDTA1 to the first display region 510, the first TED 300 may transmit a request REQ to the second TED 400 when a first image line (or a first primary image line) of the first image data DTA1 is ready and the second TED 400 may transmit a signal ACK/NACK (i.e., acknowledge/negative acknowledge) to the first TED 300 in response to the request REQ. The signal ACK/NACK may indicate whether a first image line (or a first secondary image line) of the second image data DTA2 is ready, or is not ready, respectively.

For example, when the first image line of the second image data DTA2 is ready, the second TED 400 may transmit an acknowledge (ACK) signal to the first TED 400 as a response, and the first TED 300 may transmit a synchronization (sync) signal SYNC to the second TED 400 in response to the ACK signal ACK. The second TED 400, in response to the sync signal SYNC controls the second image data DTA2 such that image lines of the second image data DTA2 are displayed in the display panel 500*a* in synchronization with image lines of the first image data DTA1.

For example, when the first image line of the second image data DTA2 is not ready, the second TED 400 may transmit a negative acknowledge (NACK) signal NACK to the first TED 400 as a response. When the first TED 300 receives the NACK signal NACK, the first TED 300 transmits the request REQ to the second TED when a second primary image line of the first image data DTA1, consecutive to the first primary image line. After the second TED 400 receives the request REQ, the second TED 400 may transmit an ACK signal ACK to the first TED 300 when a second secondary image line of the second image data DTA2, corresponding to the second primary image line, is ready or may transmit a NACK signal NACK to the first TED 300 when the second secondary image line of the second image data DTA2 is not ready.

When the first TED 300 receives the NACK signal NACK from the second TED 400 consecutively not less than a desired reference or threshold number of times, the first TED 300 may drive a detection line DL to a first logic level (logic high level).

When the detection line DL is driven to a first logic level, the second TED 400 may transmit, to the first TED 300, a ready signal RDY indicating that a second replacement image data has been generated internally, and the first TED 300 may transmit, to the first TED 300, a sync signal SYNC for synchronizing display timings of the first replacement image data and the second replacement image data, in response to the ready signal RDY.

In addition, when the first image data DTA1 constituting one frame is displayed in the first display region 510, the first TED 300 may transmit the sync signal SYNC to the second TED 400 to notify the second TED 400 of the beginning of a new frame.

In FIG. 3, the first TED 300 may be configured to operate as a master and the second TED 400 may be configured to operate as a slave. In some example embodiments, the first TED 300 may be configured to operate as a slave and the second TED 400 may be configured to operate as a master. In other example embodiments, the first TED 300 and the second TED 400 may be configured to operate in a peer-to-peer, or other like manner. In the DDI 200, the master TED may transmit a sync signal to the slave TED such that corresponding image lines for the first display data DDTA1 and the second display data DDTA2 are displayed in synchronization with respect to each other in the display panel 500*a* or in the display panels 500*b* and 500*c*. Or, in other words, the master TED may transmit a signal to the slave TED(s) such that the slave TED(s)' display data may be displayed in accordance with the signal.

Figure 4:
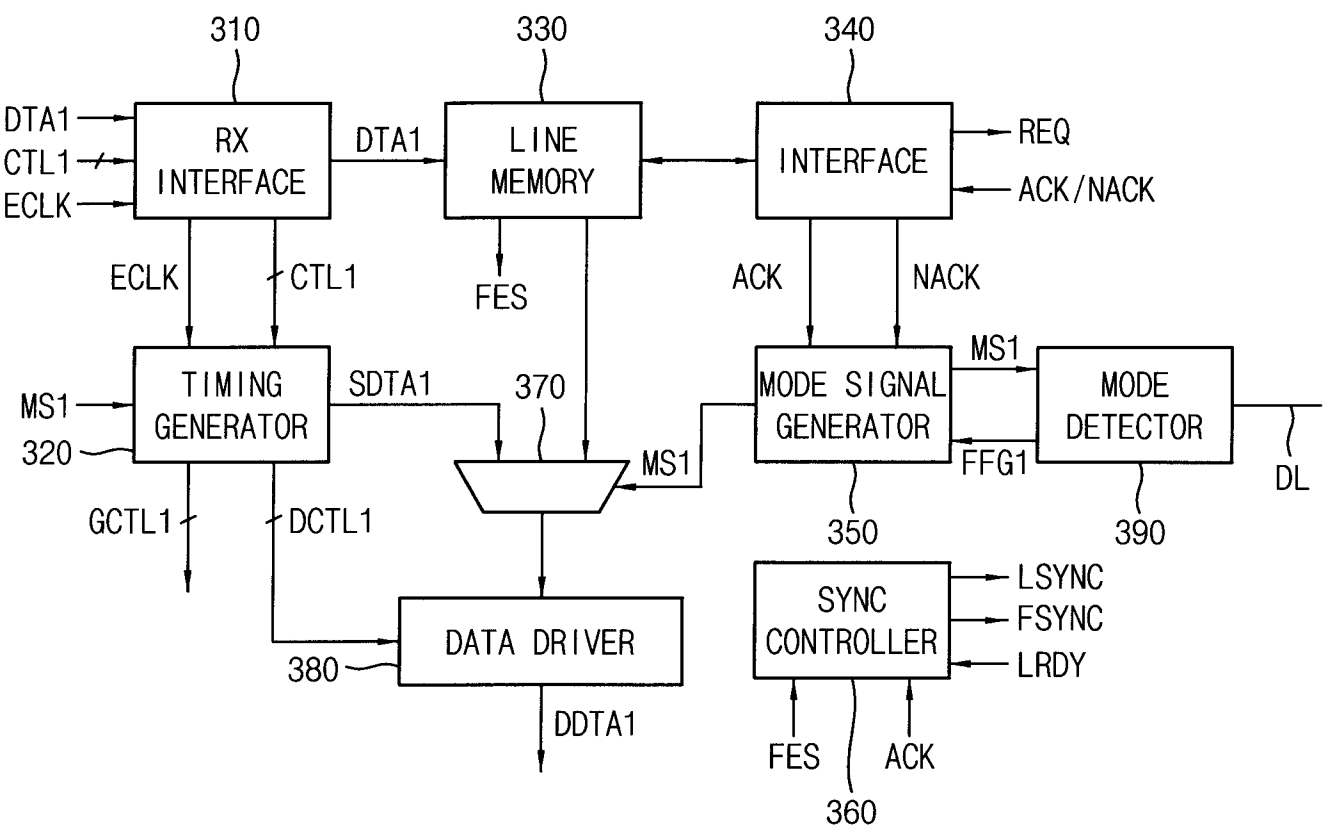
FIG. 4 is a block diagram illustrating the first timing controller-embedded driver (TED) shown in FIG. 3 according to at least one example embodiment.

FIG. 4 is a block diagram illustrating the first timing controller-embedded driver (TED) shown in FIG. 3 according to at least one example embodiment.

Referring to FIG. 4, the first TED 300 may include a first reception interface 310, a first timing generator 320, a first line memory 330, a first interface 340, a first mode signal generator 350, a first synchronization (sync) controller 360, a first selection circuit 370, a first data driver 380 and a first mode detector 390.

The first reception interface 310 may be configured to receive the first image data DTA1, the first control signal CTL1 and the external clock signal ECLK from the application processor 100. The first reception interface 310 may be configured to provide the external clock signal ECLK and the first control signal CTL1 to the first timing generator 320 and may be configured to provide the first image data DTA1 to the first line memory 330.

The first line memory 330 may be configured to store the first image data DTA1 on an image line basis. The first line memory 330 may be configured to provide the first selection circuit 370 with the stored first image data DTA1 on an image line basis. When a last image line in one frame of the first image data DTA1 has been provided to the first selection circuit 370, the first line memory 330 may be configured to provide the first sync controller 360 with a frame ending signal FES indicating that the last image line in one frame of the first image data DTA1 has been provided to the first selection circuit 370.

The first timing generator 320 may be configured to receive the external clock signal ECLK, the first control signal CTL1 and a first mode signal MS1. The first timing generator 320 may be configured to generate a first data control signal DCTL1 for controlling the first data driver 380 and a second gate control signal GCTL1 for controlling the first gate drive 210, based on the first control signal CTL1. The first timing generator 320 may be configured to generate a first replacement image data SDTA1 to be provided to the first selection circuit 370 in a fail safe mode, based on the external clock signal ECLK and the first mode signal MS1.

The first interface 340 may be connected to the first line memory 330. When the first primary image line of the first image data DTA1 is stored in the first line memory 330, the first interface 340 may transmit the request REQ to the second TED 400 for checking whether a first secondary image line of the second image data DTA2, corresponding to the first primary image line of the first image data DTA1 is ready. The first interface 340 may receive from the second TED 400 the signal ACK/NACK indicating whether the first secondary image line of the second image data DTA2 is ready or not ready and may provide the signal ACK/NACK to the first mode signal generator 350. The first interface 340 may provide the ACK signal ACK to the first sync controller 360. The first interface 360 may be implemented with a serial peripheral interface (SPI) and/or an inter-integrated circuit (I2C) interface.

When the first mode signal generator 350 receives the ACK signal ACK from the second TED 400, the first mode signal generator 350 may be configured to generate the first mode signal MS1 with a first logic level to the first timing generator 320 and the first selection circuit 370. When the first mode signal generator 350 receives the NACK signal NACK consecutively not less than a desired reference or threshold number of times, the first mode signal generator 350 may be configured to generate the first mode signal MS1 with a second logic level to the first timing generator 320, the first selection circuit 370 and the first mode detector 390.

When the first sync controller 360 receives from the second TED 400 the ACK signal indicating that the first secondary image line of the second image data DTA2 corresponding to the first primary image line of the first image data DTA1 is ready, the first sync controller 360 may be configured to transmit a line sync signal LSYNC to the second TED 400 such that the corresponding image lines for the first display data DDTA1 and the second display data DDTA2 are displayed in synchronization with respect to each other in the display panel 500*a* or in the display panels 500*b* and 500*c*. After a desired and/or predetermined time elapses after the first sync controller 360 receives the frame ending signal FES from the first line memory 330, the first sync controller 360 may transmit, to the second TED 400, a frame sync signal FSYNC indicating that a new frame to be displayed is ready.

When the first sync controller 360 receives from the second TED 400 a line ready signal LRDY indicating that the second replacement image data is ready in the fail safe mode, the sync controller 360 may transmit to the second TED 400 the line sync signal LSYNC for synchronizing corresponding image lines of the first replacement image data SDTA1 and the second replacement image data, in response to the line ready signal LRDY.

The first selection circuit 370 may include a multiplexer that may select at least one of the first image data DTA1 provided from the first line memory 330 on an image line basis and the first replacement image data SDTA1, in response to the first mode signal MS1, and may also provide the selected image data to the first data driver 380. The first selection circuit 370 may be configured to select the first image data DTA1 in response to the first mode signal MS1 with a first logic level. The first selection circuit 370 may be configured to select the first replacement image data SDTA1 in response to the first mode signal MS1 with a second logic level.

The first data driver 380 may be configured to provide the first display region 510 with an output of the first selection circuit 370 as the first display data DDTA1 according to the first data control signal DCTL1.

The first mode detector 390 may be connected to the second TED 400 through the detection line DL and may drive the detection line DL to a first logic level (logic high level), in response to the first mode signal MS1 with a second logic level. When the first mode detector 390 detects that the detection line DL is driven to a first logic level by the second TED 400, the first mode detector 390 may be configured to activate a first fail flag signal FFG1 to the first mode signal generator 350. The first mode signal generator 350 may be configured to output the first mode signal MS1 with a second logic level in response to the first fail flag signal FFG1 with a first logic level.

Figure 5:
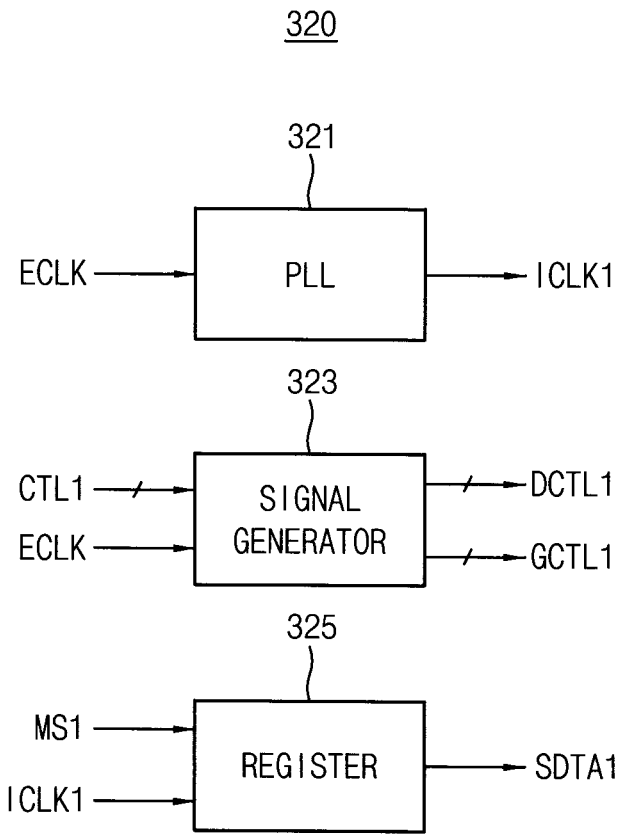
FIG. 5 is a block diagram illustrating the first timing generator shown in FIG. 4 according to at least one example embodiment.

FIG. 5 is a block diagram illustrating the first timing generator shown in FIG. 4 according to at least one example embodiment.

Referring to FIG. 5, the first timing generator 320 may include a clock generator 321, a signal generator 323 and a register 325. The clock generator 321 may include a phase-locked loop circuit.

The clock generator 321 may be configured to receive the external clock signal ECLK to generate a first internal clock signal ICLK1. The signal generator 323 may be configured to generate the first data control signal DCTL1 and the first gate control signal GCTL1 based on the external clock signal ECLK and the first control signal CTL1. The register 325 may store the first replacement image data SDTA1 and may output the first replacement image data SDTA1 based on the first mode signal MS1 and the first internal clock signal ICLK1. The register 325 may store the first replacement image data SDTA1 and may output the first replacement image data SDTA1 based on the first internal clock signal ICLK1 when the first mode signal MS1 has a second logic level. The first mode signal MS1 may have a second logic level in the fail safe mode or a panel refresh mode.

Figure 6:
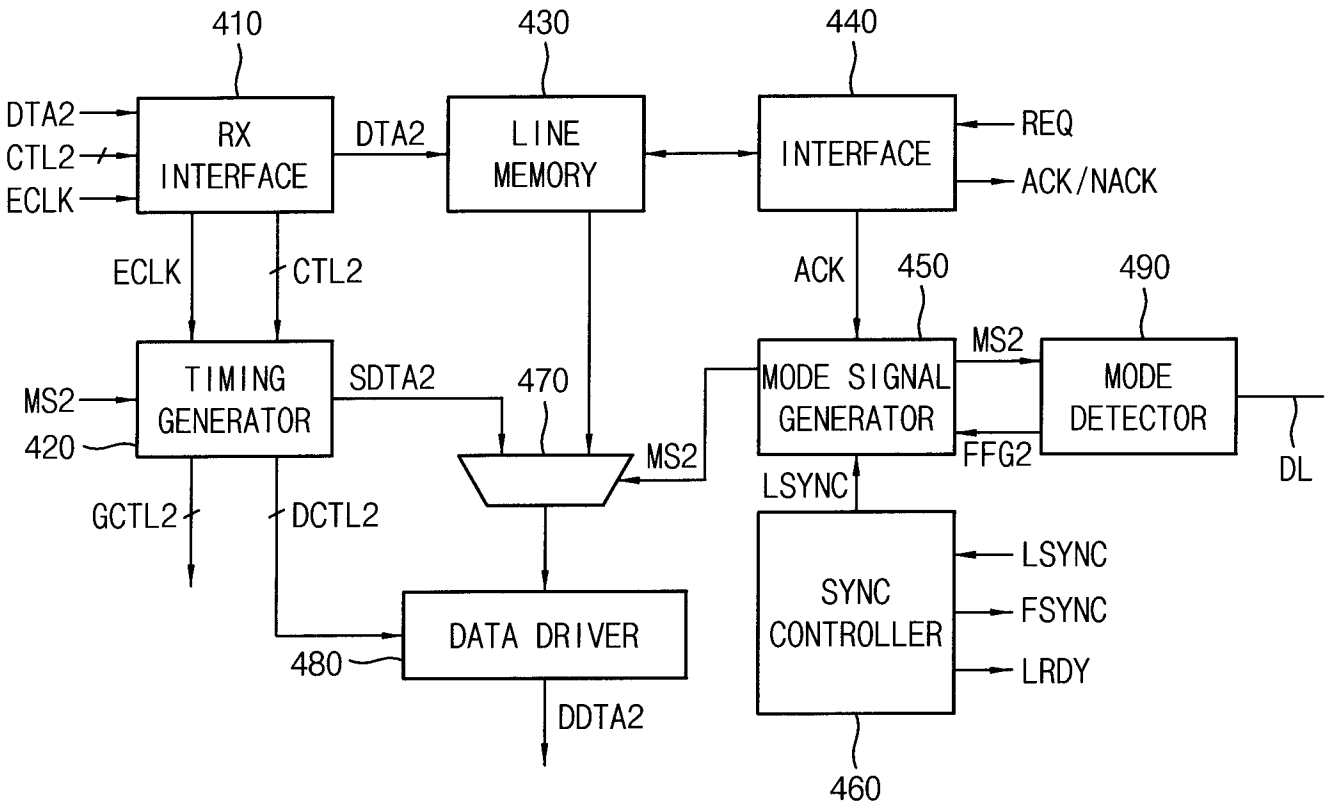
FIG. 6 is a block diagram illustrating the second TED shown in FIG. 3 according to at least one example embodiment.

FIG. 6 is a block diagram illustrating the second TED shown in FIG. 3 according to at least one example embodiment.

Referring to FIG. 6, the second TED 400 may include a second reception interface 410, a second timing generator 420, a second line memory 430, a second interface 440, a second mode signal generator 450, a second sync controller 460, a second selection circuit 470, a second data driver 480 and a second mode detector 490.

The second reception interface 410 may be configured to receive the second image data DTA2, the second control signal CTL2 and the external clock signal ECLK from the application processor 100. The second reception interface 410 may be configured to provide the external clock signal ECLK and the second control signal CTL2 to the second timing generator 420 and may be configured to provide the second image data DTA2 to the second line memory 430.

The second line memory 430 may store the second image data DTA4 on an image line basis. The second line memory 430 may provide the second selection circuit 470 with the stored second image data DTA2 on an image line basis.

The second timing generator 420 may be configured to receive the external clock signal ECLK, the second control signal CTL2 and a second mode signal MS2. The second timing generator 420 may be configured to generate a second data control signal DCTL2 for controlling the second data driver 480 and a second gate control signal GCTL2 for controlling the second gate drive 220, based on the second control signal CTL2. The second timing generator 420 may be configured to generate a second replacement image data SDTA2 to be provided to the second selection circuit 470 in the fail safe mode, based on the external clock signal ECLK and the second mode signal MS2.

The second interface 440 may be connected to the second line memory 430. The second interface 440 may transmit to the first TED 300 the signal ACK/NACK indicating whether the second secondary image line of the second image data DTA2 is stored in the second line memory 430 or not. The second interface 440 may provide the ACK signal to the second sync controller 460. The second interface 460 may be implemented with an SPI and/or an I2C interface.

When the second mode signal generator 450 receives the line sync signal LSYNC from the second sync controller 460, the second mode signal generator 450 may be configured to generate the second mode signal MS2 with a second logic level to the second timing generator 420 and the second selection circuit 470. When the second mode signal generator 350 does not receive from the second interface 440 the ACK signal ACK not less than a desired reference or threshold number of times, the second mode signal generator 450 may be configured to generate the second mode signal MS2 with a second logic level to the second timing generator 420, the second selection circuit 470 and the second mode detector 490.

The second sync controller 460 may be configured to receive from the first TED 300 the line sync signal LSYNC and the frame sync signal FSYNC and may be configured to provide the line sync signal LSYNC to the second mode signal generator 450. The second sync controller 460 may transmit to the first TED 300 the line ready signal LRDY indicating that the second replacement image data SDTA2 is ready in the fail safe mode.

The second selection circuit 470 may include a multiplexer that may be configured to select at least one of the second image data DTA4 provided from the second line memory 430 on an image line basis and the second replacement image data SDTA4, in response to the second mode signal MS2 and may provide the selected data to the second data driver 480. The second selection circuit 470 may be configured to select the second image data DTA2 in response to the second mode signal MS2 with a first logic level. The second selection circuit 470 may be configured to select the second replacement image data SDTA2 in response to the second mode signal MS2 with a second logic level.

The second data driver 480 may be configured to provide the second display region 550 with an output of the second selection circuit 470 as the second display data DDTA2 according to the second data control signal DCTL2.

The second mode detector 490 may be connected to the first TED 300 through the detection line DL and may be configured to drive the detection line DL to a first logic level (logic high level) in response to the second mode signal MS1 with a second logic level. When the second mode detector 490 detects that the detection line DL is driven to a first logic level by the first TED 300, the second mode detector 490 may be configured to activate a second fail flag signal FFG2 to the second mode signal generator 450. The second mode signal generator 450 may output the second mode signal MS2 with a second logic level in response to the second fail flag signal FFG2 with a first logic level.

Figure 7:
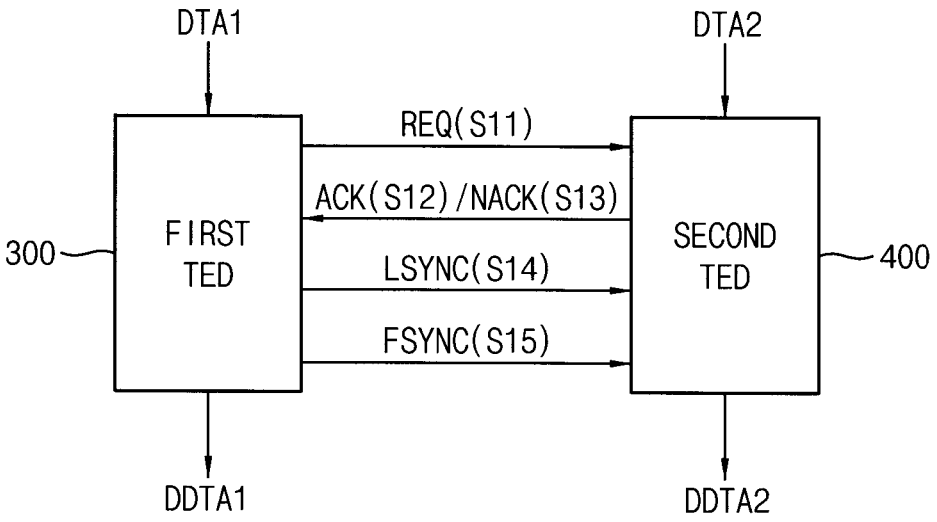
FIG. 7 illustrates signals transferred between the first TED and the second TED in a normal display mode according to at least one example embodiment.

FIG. 7 illustrates signals transferred between the first TED and the second TED in a normal display mode according to at least one example embodiment.

Referring to FIGS. 3, 4, 6 and 7, when a first image line of the first image data DTA1 is stored in the first line memory 330, the first TED 300 may be configured to transmit the request REQ to the second TED 400 (S11). When a first image line of the second image data DTA2 is stored in the second line memory 430, the second TED 400 may be configured to transmit the ACK signal to the first TED 300 in response to the request REQ (S12). In response to the ACK signal, the first TED 300 may transmit the line sync signal LSYNC to the second TED 400 such that the corresponding image lines of the first display data DDTA1 and the second display data DDTA2 may be displayed in the first display region 510 and the second display region 550 in synchronization with respect to each other (S14). When the first image line of the second image data DTA2 is not stored in the second line memory 430, the second TED 400 may transmit the NACK signal NACK to the first TED 300 in response to the request REQ (S13). The first TED 300 may repeat procedures S11 and S12 on a second image line of the first image data DTA1, in response to the NACK signal NACK.

When the display of the first display data DDTA1 on one frame is completed, the first TED 300 may transmit, to the second TED 400, the frame sync signal FSYNC indicating that a new frame to be displayed is ready (S15).

Figure 8:
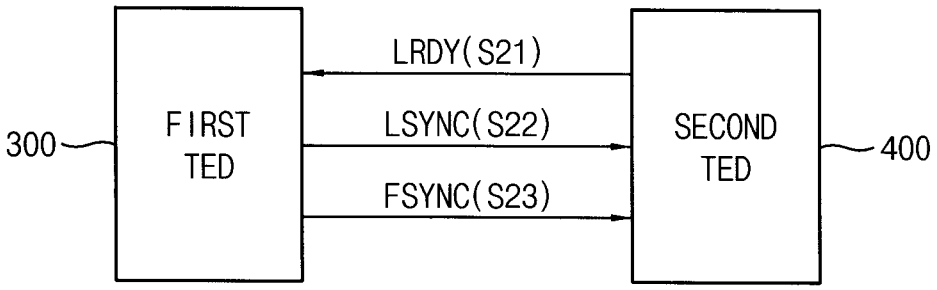
FIG. 8 illustrates signals transferred between the first TED and the second TED in a fail safe mode according to at least one example embodiment.

FIG. 8 illustrates signals transferred between the first TED and the second TED in a fail safe mode according to at least one example embodiment.

Referring to FIGS. 3, 4, 6 and 8, when the second replacement image data SDTA2 is ready in the fail safe mode, the second TED 400 may transmit the line ready signal LRDY to the first TED 300 (S21). In response to the line ready signal LRDY, the first TED 300 may transmit the line sync signal LSYNC to the second TED 400 such that the corresponding image lines of the first replacement image data SDTA1 and the second replacement image data SDTA2 are displayed in the first display region 510 and the second display region 550 in synchronization with respect to each other (S22).

When the display of the first replacement image data SDTA1 on one frame is completed, the first TED 300 may transmit to the second TED 400 the frame sync signal FSYNC indicating that a new frame to be displayed is ready (S23).

Figure 9:
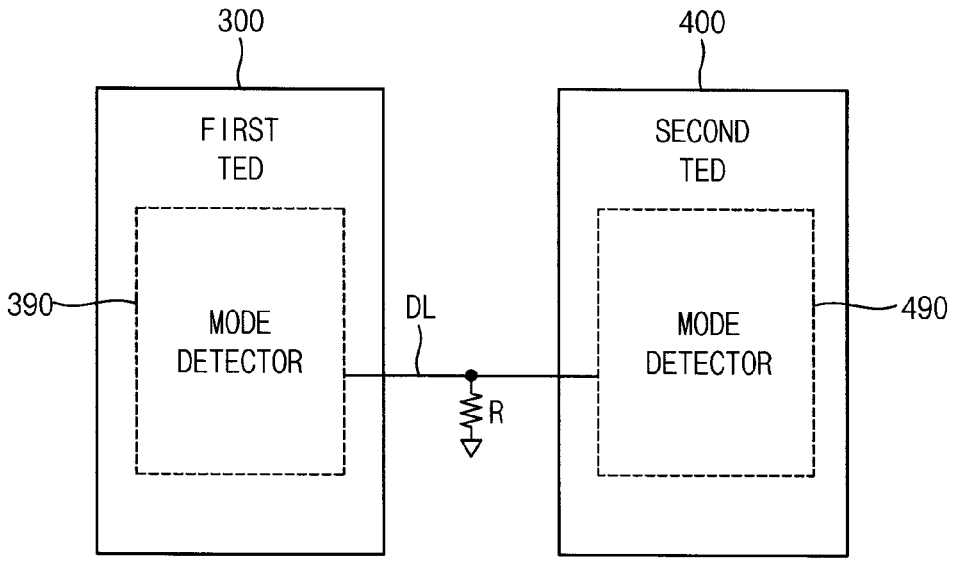
FIG. 9 illustrates a connection relationship between the first mode detector in the first TED and the second mode detector in the second TED according to at least one example embodiment.

FIG. 9 illustrates a connection relationship between the first mode detector in the first TED and the second mode detector in the second TED according to at least one example embodiment.

Referring to FIGS. 4, 6 and 9, the first mode detector 390 and the second mode detector 490 may be connected to each other through the detection line DL, and the detection line DL may be connected to the ground via a resistor R.

Figure 10:
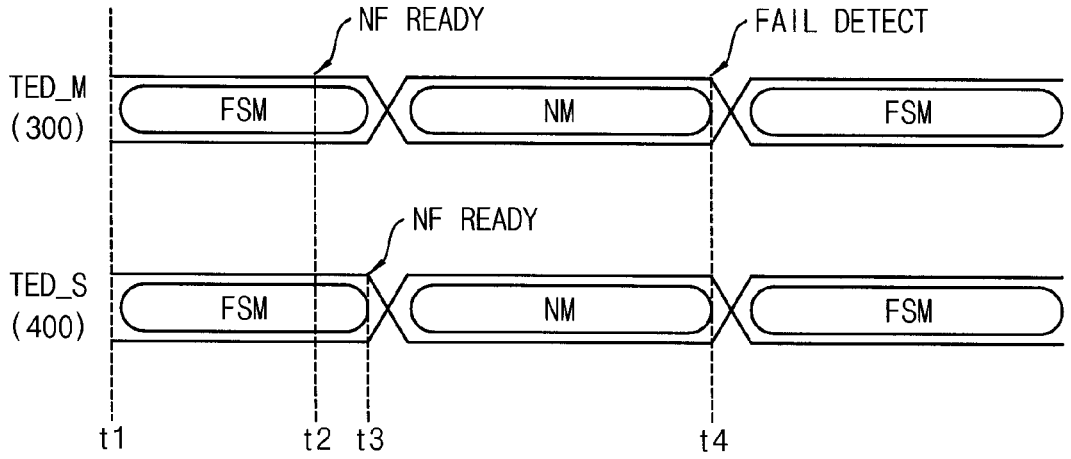
FIG. 10 illustrates operation of the DDI shown in FIG. 3 according to at least one example embodiment.

FIG. 10 illustrates operation of the DDI shown in FIG. 3 according to one example embodiment.

Referring to FIGS. 3, 9 and 10, at a time t1, the first TED 300 and the second TED 400 may operate in the fail safe mode (FSM). In this case, a replacement image data may be displayed in the display panel 500*a* or the display panels 500*b* and 500*c*. At a time t2, a normal frame (NF), i.e., the first image data DTA1, may be ready in the first TED 300 and at a time t3, another normal frame (NF), i.e., the second image data DTA2, may be ready in the second TED 400.

Therefore, the corresponding image lines of the first display data DDTA1 and the second display data DDTA2 may be displayed in synchronization with respect to each other in the display panel 500*a* or in the display panels 500*b* and 500*c* during a normal display mode (NM). At a time t4, when a fail is detected in the first TED 300, the first mode detector 390 may drive the detection line DL to a first logic level, and the first TED 300 and the second TED 400 may operate in the fail safe mode (FSM).

Figure 11:
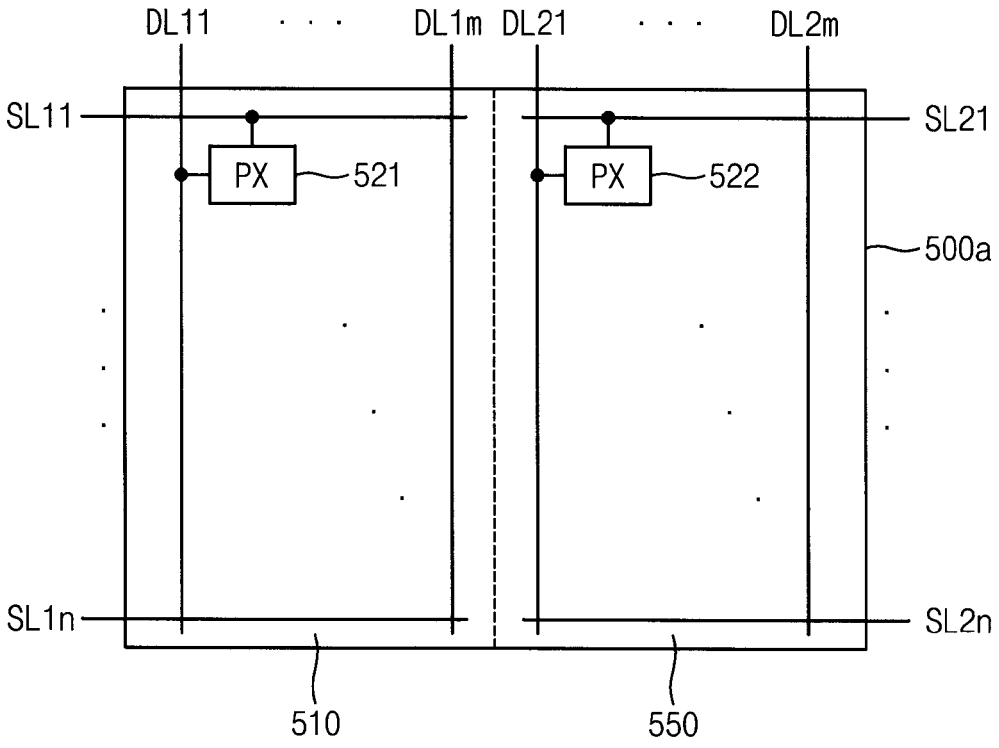
FIG. 11 illustrates an example of the display panel in FIG. 1A according to at least one example embodiment.

FIG. 11 illustrates an example of the display panel in FIG. 1A according to at least one example embodiment.

Referring to FIG. 11, the display panel 500*a* may be divided into the first display region 510 and the second display region 550.

The first display region 510 may include a plurality of pixels 521 connected to a first data line group DL11~DL1*m* and a first scan line group SL11~SL1*n*, and the second display region 550 may include a plurality of pixels 522 connected to a second data line group DL21~DL2*m* and a second scan line group SL21~SL2*n*, where m and n are integers.

The first data driver 380 may apply the first display data DDTA1 to the first data line group DL11~DL1*m* and the first gate driver 210 may sequentially drive the first scan signal SCN1 to the first scan line group SL11~SL1*n*. The second data driver 480 may apply the second display data DDTA2 to the second data line group DL21~DL2*m* and the second gate driver 220 may sequentially drive the second scan signal SCN2 to the second scan line group SL21~SL2*n*.

Each corresponding scan line of the first scan line group SL11~SL1*n* and the second scan line group SL21~SL2*n* may be connected to each other.

Although, the first display region 510 and the second display region 550 are included in the display panel 500*a* in FIG. 11, the first display region 510 and the second display region 550 are respectively in the first display panel 500*b* and the second display panel 500*c*.

Figure 12:
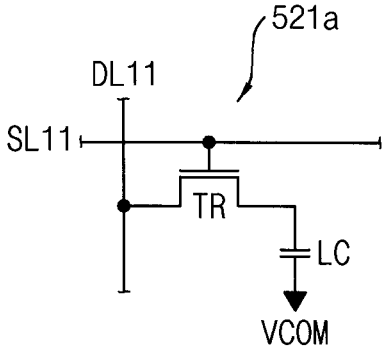
FIG. 12 illustrates one of the pixels shown in FIG. 11 according to at least one example embodiment.

FIG. 12 illustrates one of the pixels shown in FIG. 11 according to at least one example embodiment.

Referring to FIG. 12, a pixel 521*a* may include a transistor TR and a liquid crystal capacitor LC. The transistor TR may have a gate coupled to the scan line SL11, a first electrode coupled to the data line DL11 and a second electrode coupled to the liquid crystal capacitor LC. The liquid crystal capacitor LC may have a first terminal coupled to the transistor TR and a second terminal coupled to a common voltage terminal VCOM. Since the pixel 521*a* includes the liquid crystal capacitor, the display panel 500*a* may be a liquid crystal display (LCD).

Figure 13:
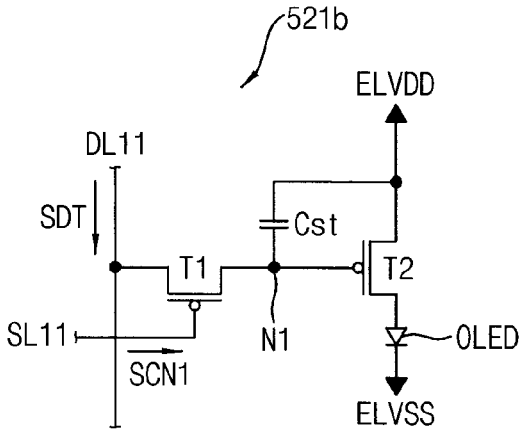
FIG. 13 illustrates one of the pixels shown in FIG. 11 according to at least one example embodiment.

FIG. 13 illustrates one of the pixels shown in FIG. 11 according to at least one example embodiment.

Referring to FIG. 13, a pixel 521*b* may include a switching transistor T1, a storage capacitor Cst, a driving transistor T2 and an organic light emitting diode OLED.

The switching transistor T1 may include a p-channel metal-oxide semiconductor (PMOS) transistor that may have a first terminal coupled to the data line DL11 to receive a data voltage SDT, a gate terminal coupled to the scan line SL11 to receive the first scan signal SCN1 and a second terminal coupled to a first node N1. The driving transistor T2 may include a PMOS transistor that may have a first terminal coupled to the high power supply voltage ELVDD, a gate terminal coupled to the first node N1 and a second terminal coupled to the organic light emitting diode OLED. The storage capacitor Cst may have a first terminal coupled to the high power supply voltage ELVDD and a second terminal coupled to the first node N1. The organic light emitting diode OLED may have an anode electrode coupled to the second terminal of the driving transistor T2 and a cathode electrode coupled to the low power supply voltage ELVSS.

The switching transistor T1 may transfer the data voltage SDT to the storage capacitor Cst in response to the first scan signal SCN1 and the organic light emitting diode OLED may emit light in response to the data voltage SDT stored in the storage capacitor Cst to display image.

In some example embodiments, the pixels 521*b* may be driven in a digital driving method. In the digital driving method of the pixel, the driving transistor T2 may be operated as a switch in a linear region. Accordingly, the driving transistor T2 may represent one of a turn on state and a turn off state.

To turn on or turn off the driving transistor T2, the data voltage SDT may have two levels including a turn on level and a turn off level. In the digital driving method, the pixel 521*b* may represent one of the turn on state and the off state so that a single frame may be divided into a plurality of subfields to represent various grayscales. The turn on status and the turn off status of the pixel during each of the subfields are combined so that the various grayscales of the pixel may be represented.

Figure 14A:
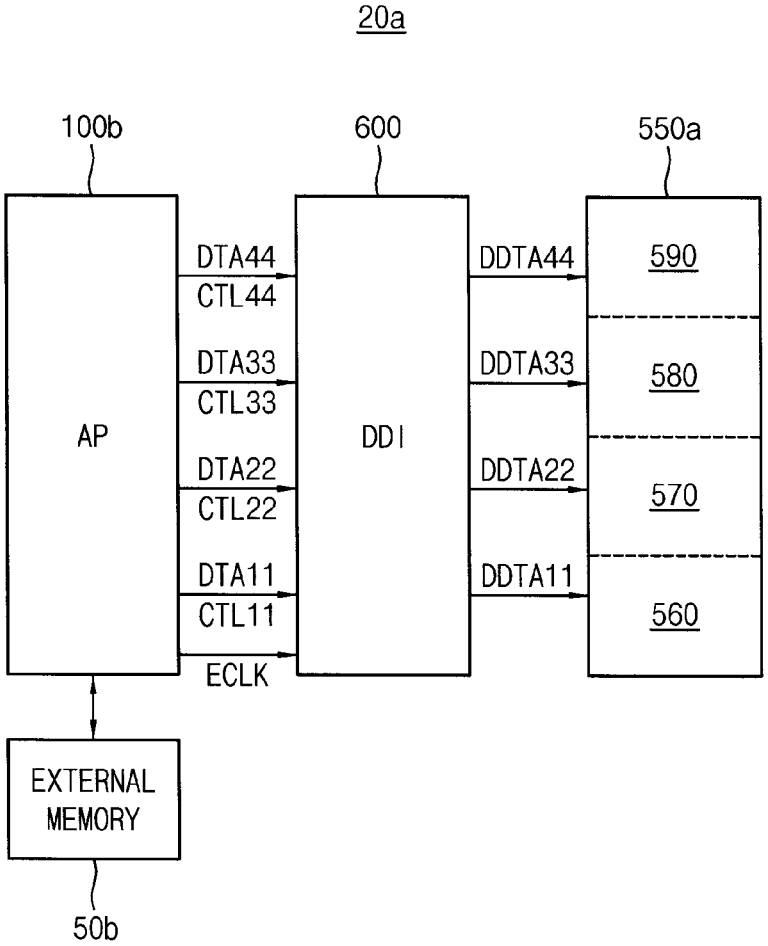
FIGS. 14A and 14B are block diagrams respectively illustrating display systems according to at least one example embodiment.
Figure 14B:
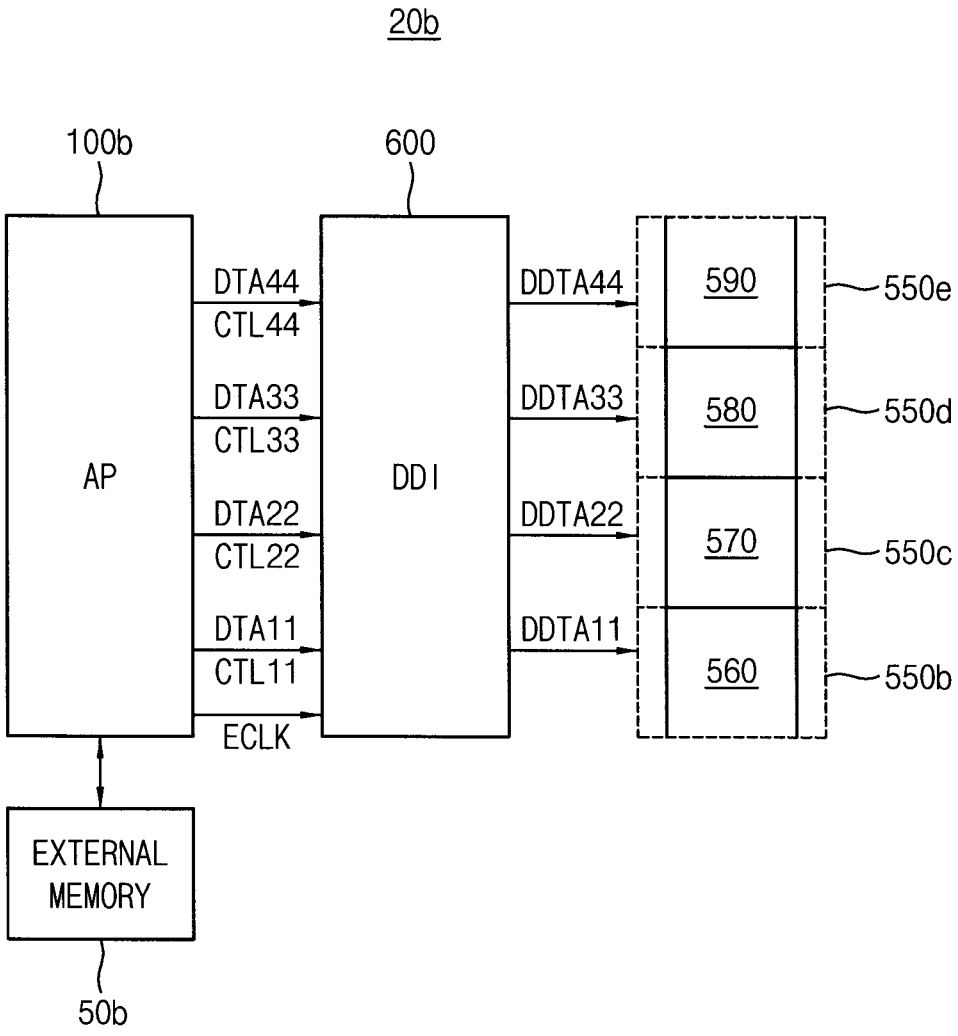

FIGS. 14A and 14B are block diagrams respectively illustrating display systems according to some example embodiments.

Referring to FIGS. 14A and 14B, a display system (or, an image data processing system) 20*a* or 20*b* may include an application processor 100*b*, an external memory 50*b*, DDI 600 and at least one display panel 550*a* or 550*b*, 550*c*, 550*d* and 550*e*.

The application processor 100*b* may control the external memory 50*b* and/or the DDI 600. In FIG. 14A, the display panel 550*a* may include first through fourth display regions 560, 570, 580 and 590. In FIG. 14B, the first through fourth display panels 550*b*, 550*c*, 550*d* and 550*e* may include the first display region 510 and the second display panel 500*c* may include the first through fourth display regions 560, 570, 580 and 590 respectively. The external memory 50*b* may include display data to be displayed in the first through fourth display regions 560, 570, 580 and 590.

The application processor 100*b* may be configured to provide the DDI 600 with a first image data DTA11 and a first control signal CTL11 associated with the first image data DTA11, may be configured to provide the DDI 600 with a second image data DTA22 and a second control signal CTL22 associated with the second image data DTA22, may be configured to provide the DDI 600 with a third image data DTA33 and a third control signal CTL33 associated with the third image data DTA33 and may be configured to provide the DDI 600 with a fourth image data DTA44 and a fourth control signal CTL44 associated with the fourth image data DTA44.

The DDI 600 may be configured to process the first image data DTA11 according to the first control signal CTL11 to transmit a first display data DDTA11 to the first display region 560, may be configured to process the second image data DTA22 according to the second control signal CTL22 to transmit a second display data DDTA22 to the second display region 570, may be configured to process the third image data DTA33 according to the third control signal CTL33 to transmit a third display data DDTA33 to the third display region 580, and may be configured to process the fourth image data DTA44 according to the fourth control signal CTL44 to transmit a fourth display data DDTA44 to the fourth display region 590.

The DDI 600 may include first through fourth TEDs that process the first through fourth image data DTA1~DTA4 respectively. One TED of the first through fourth TEDs, may operate as a master that may control the other TEDs and control the display timings of the first through fourth display data DDTA11~DDTA44 such that corresponding image lines of the first through fourth display data DDTA11~DDTA44 are displayed in synchronization with respect to each other in the display panel 500*a* or the display panels 550*b*, 550*c*, 550*d* and 550*e*. Alternatively, the TEDs may operate in a peer-to-peer command manner, or other like command manner.

Figure 15:
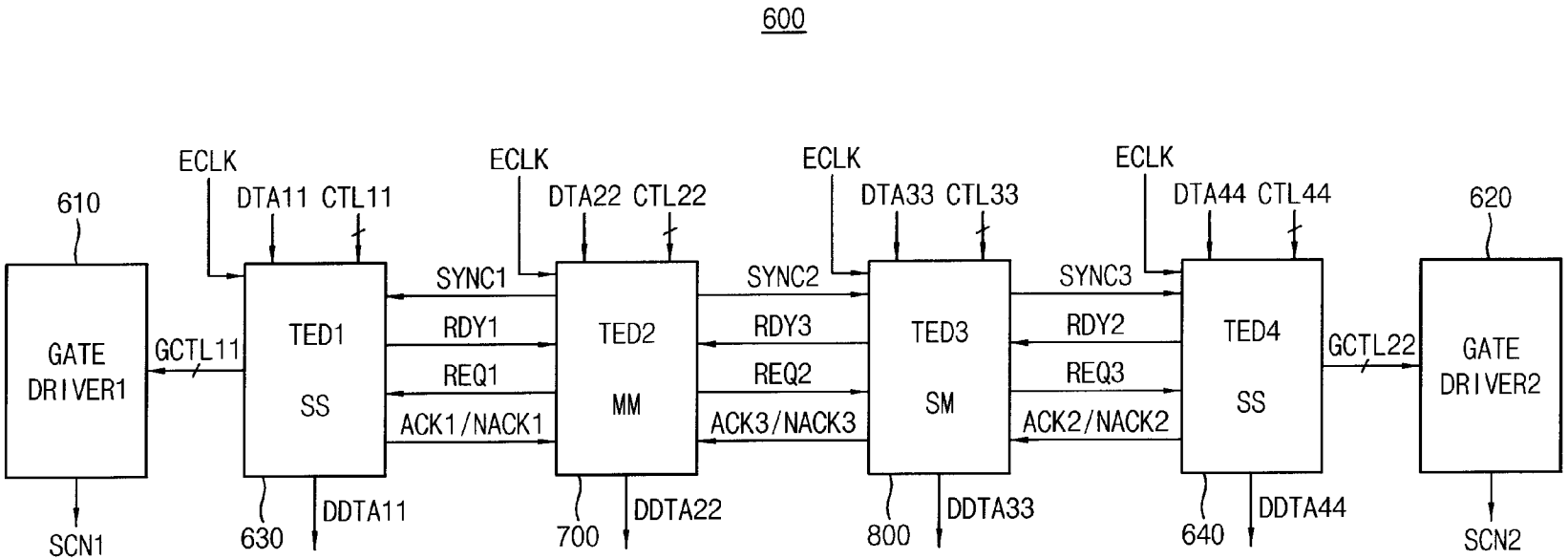
FIG. 15 is a block diagram illustrating the DDI in FIG. 14A or FIG. 14B according to at least one example embodiment.

FIG. 15 is a block diagram illustrating the DDI in FIG. 14A or FIG. 14B according to at least one example embodiment.

Referring to FIG. 15, the DDI 600 may include first through fourth TEDs 630, 700, 800 and 640, a first gate driver 610 and a second gate driver 620.

The first TED 630 may be configured to receive the first image data DTA11, the first control signal CTL11 and the external clock signal ECLK from the application processor 100*b* and may be configured to provide the first gate driver 610 with a first gate control signal GCTL11 for controlling the first gate driver 610. The first TED 630 may be configured to process the first image data DTA11 to provide the first display data DDTA11 to the first display region 560. The first gate driver 610 may sequentially drive a first scan signal SCN1 to scan lines in the first display region 560 and the second display region 570 in response to the first gate control signal GCTL11.

The second TED 700 may be configured to receive the second image data DTA22, the second control signal CTL22 and the external clock signal ECLK from the application processor 100*b* and may be configured to process the second image data DTA22 to provide the second display data DDTA22 to the second display region 570.

The third TED 800 may be configured to receive the third image data DTA33, the third control signal CTL33 and the external clock signal ECLK from the application processor 100*b* and may be configured to process the third image data DTA33 to provide the third display data DDTA33 to the third display region 580.

The fourth TED 640 may be configured to receive the fourth image data DTA44, the fourth control signal CTL44 and the external clock signal ECLK from the application processor 100*b* and may be configured to provide the second gate driver 620 with a second gate control signal GCTL22 for controlling the second gate driver 620. The fourth TED 640 may be configured to process the fourth image data DTA44 to provide the fourth display data DDTA44 to the fourth display region 590. The second gate driver 620 may sequentially drive a second scan signal SCN2 to scan lines in the third display region 580 and the fourth display region 590 in response to the second gate control signal GCTL22.

In FIG. 15, the second DDI 700 may be configured to operate as a master with respect to the first TED 630 and the third TED 800, and the third TED 800 may be configured to operate as a slave to the second TED 700 and may be configured to operate as a master to the fourth TED 640. Or, in other words, a single TED may operate as both a master and a slave at the same time in relation to other TEDs. The second TED 700, which may be configured to operate as a master, may transmit a sync signal SYNC1 to the first TED 630, may transmit a sync signal SYNC2 to the third TED 800, and may transmit a sync signal SYNC3 to the fourth TED 640 via the third TED 800 such that the corresponding image lines of the first through fourth display data DDTA11~DDTA44 are displayed in synchronization with respect to each other in the first through fourth display regions 560, 570, 580 and 590.

When a first image line of the second image data DTA22 is ready in a normal display mode, the second TED 700 may transmit a request REQ1 to the first TED 630 and may transmit a request REQ2 to the third TED 800. The third TED 800 may repeat the request REQ2 to transmit a request REQ3 to the fourth TED 640.

The first TED 630 may transmit an ACK signal ACK1 to the second TED 700 in response to the request REQ1 when a first image line of the first image data DTA11 is ready, or the first TED 630 may transmit a NACK signal NACK1 to the second TED 700 in response to the request REQ1 when the first image line of the first image data DTA11 is not ready.

The fourth TED 640 may transmit an ACK signal ACK2 to the third TED 800 in response to the request REQ3 when a first image line of the fourth image data DTA22 is ready, or the fourth TED 640 may transmit a NACK signal NACK2 to the third TED 800 in response to the request REQ3 when the first image line of the fourth image data DTA44 is not ready.

The third TED 800 may transmit an ACK signal ACK3 to the second TED 700 in response to the request REQ2 when a first image line of the third image data DTA33 is ready and the third TED 800 may receive the ACK signal ACK2 from the fourth TED 640, or the third TED 800 may transmit a NACK signal NACK3 to the second TED 700 in response to the request REQ3 when the first image line of the third image data DTA33 is not ready or the third TED 800 may receive the NACK signal NACK2 from the fourth TED 640.

When the second TED 700 receives both the ACK signal ACK1 and the ACK signal ACK3, the second TED 700 may transmit the sync signal SYNC1 to the first TED 630, the second TED 700 may transmit the sync signal SYNC2 to the third TED 800 and the third TED 800 may repeat the sync signal SYNC2 to transmit the sync signal SYNC3 to the fourth TED 640 such that the corresponding image lines of the first through fourth display data DDTA11~DDTA44 are displayed in synchronization with respect to each other in the first through fourth display regions 560, 570, 580 and 590.

When a first replacement image data is ready in a fail safe mode, the first TED 630 may transmit a ready signal RDY1 to the second TED 700. When a fourth replacement image data is ready in a fail safe mode, the fourth TED 640 may transmit a ready signal RDY2 to the third TED 800. When a third replacement image data is ready in a fail safe mode and the third TED 800 receives the ready signal RDY2, the third TED 800 may transmit a ready signal RDY3 to the second TED 700. When the second TED 700 receives both the ready signal RDY1 and the ready signal RDY3, the second TED 700 may transmit the sync signal SYNC1 to the first TED 630, the second TED 700 may transmit the sync signal SYNC2 to the third TED 800 and the third TED 800 may repeat the sync signal SYNC2 to transmit the sync signal SYNC3 to the fourth TED 640 such that the corresponding image lines of the first through fourth replacement image data are displayed in synchronization with respect to each other in the first through fourth display regions 560, 570, 580 and 590.

Figure 16:
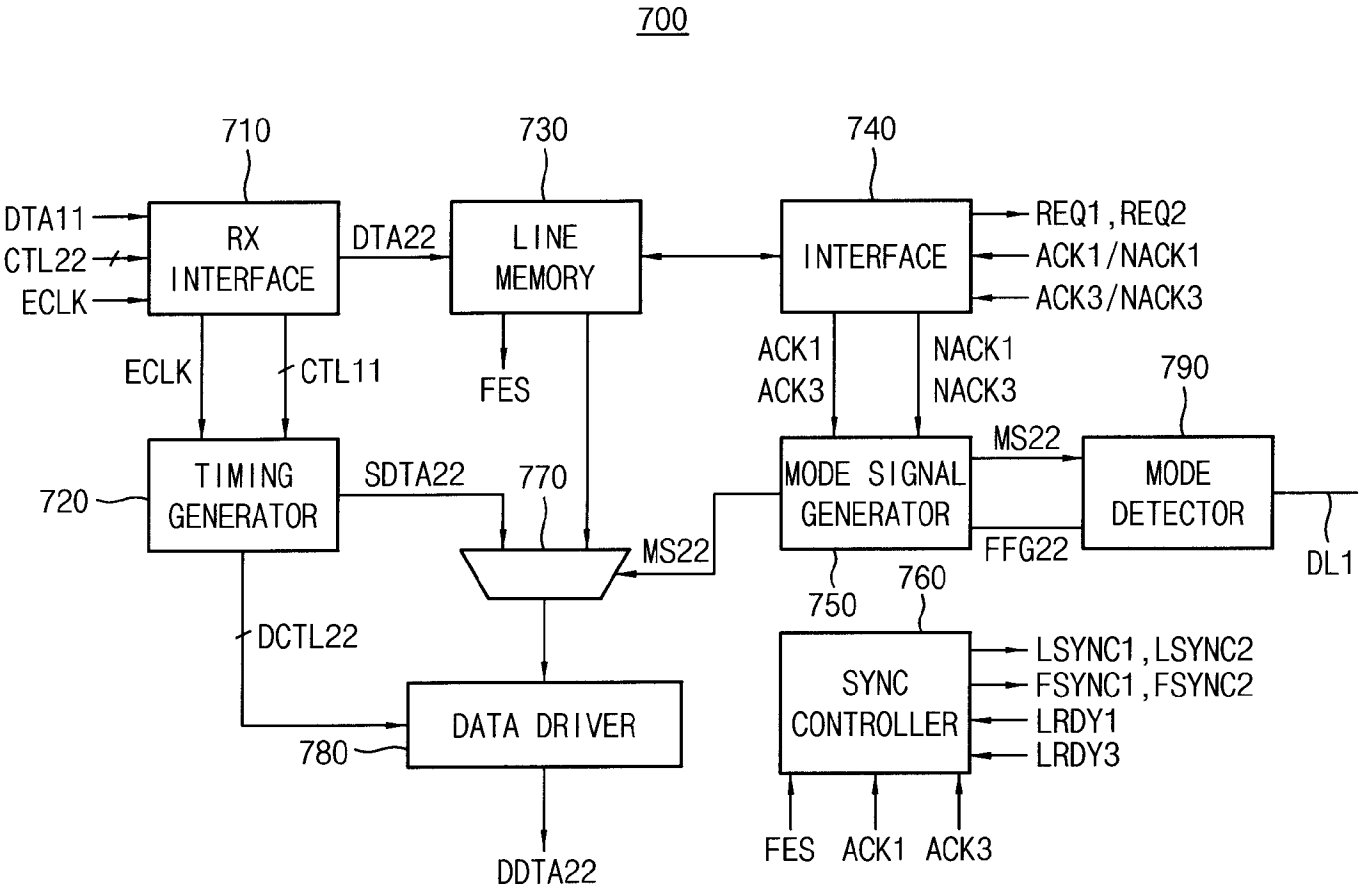
FIG. 16 is a block diagram illustrating the second TED shown in FIG. 15 according to at least one example embodiment.

FIG. 16 is a block diagram illustrating the second TED shown in FIG. 15 according to at least one example embodiment.

Referring to FIG. 16, the second TED 700 may include a reception interface 710, a timing generator 720, a line memory 730, an interface 740, a mode signal generator 750, a sync controller 760, a selection circuit 770, a data driver 780 and a mode detector 790.

The reception interface 710 may receive the second image data DTA22, the second control signal CTL22 and the external clock signal ECLK. The reception interface 710 may provide the external clock signal ECLK and the second control signal CTL22 to the timing generator 720 and may provide the second image data DTA22 to the line memory 730.

The line memory 730 may store the second image data DTA22 on an image line basis. The line memory 730 may provide the selection circuit 770 with the stored second image data DTA22 on an image line basis. When a last image line in one frame of the second image data DTA22 is provided to the selection circuit 770, the line memory 730 may provide the sync controller 760 with a frame ending signal FES indicating that the last image line in one frame of the second image data DTA22 is provided to the selection circuit 770.

The timing generator 720 may receive the external clock signal ECLK, the second control signal CTL22 and a mode signal MS22. The timing generator 720 may generate a data control signal DCTL22 for controlling the data driver 780, based on the second control signal CTL22. The timing generator 720 may generate a second replacement image data SDTA22 to be provided to the selection circuit 770 in a fail safe mode, based on the external clock signal ECLK and the mode signal MS22.

The interface 740 may be connected to the line memory 730. When the first image line of the second image data DTA22 is stored in the line memory 730, the interface 740 may transmit the request REQ1 to the first TED 630 and may transmit the request REQ2 to the third TED 800. The interface 740 may receive the signal ACK1/NACK1 from the first TED 630 and may receive the signal ACK3/NACK3 from the third TED 800. The interface 740 may provide the signals ACK1/NACK1 and ACK3/NACK3 to the mode signal generator 750.

When the first mode signal generator 750 receives the ACK signals ACK1 and ACK3, the mode signal generator 750 may generate the mode signal MS22 with a first logic level to the timing generator 720 and the selection circuit 770. When the mode signal generator 750 receives one of the NACK signals NACK1 and NACK2 consecutively not less than a desired reference and/or threshold number of times, the mode signal generator 750 may generate the mode signal MS22 with a second logic level to the timing generator 720, the first selection circuit 770 and the mode detector 790.

When the sync controller 760 receives the ACK signals ACK1 and ACK3 from the interface 740, the sync controller 760 may transmit a line sync signal LSYNC1 to the first TED 630 and may transmit a line sync signal LSYNC2 to the third TED 800. After a desired and/or predetermined time elapses since the sync controller 760 receives the frame ending signal FES from the line memory 730, the sync controller 760 may transmit a frame sync signal FSYNC1 to the first TED 630 and may transmit a frame sync signal FSYNC2 to the third TED 800. Each of the frame sync signals FSYNC1 and FSYNC2 may indicate that a new frame to be displayed is ready. When the sync controller 760 receives the line ready signals LRDY1 and LRDY3 indicating that the replacement image data are ready in the fail safe mode, the sync controller 760 may transmit the line sync signal LSYNC1 to the first TED 630 and may transmit the line sync signal LSYNC2 to the third TED 800.

The selection circuit 770 may include a multiplexer and may select one of the second image data DTA22 provided from the line memory 730 on an image line basis and the second replacement image data SDTA22, in response to the mode signal MS22 and may provide the selected one to the data driver 780.

The data driver 780 may provide the second display region 570 with an output of the selection circuit 770 as the second display data DDTA22 according to the data control signal DCTL22.

The mode detector 790 may be connected to the first TED 630 and the third TED 800 through a detection line DL1 and may drive the detection line DL1 to a first logic level (logic high level), in response to the mode signal MS22 with a second logic level. When the mode detector 790 detects that the detection line DL1 is driven to a first logic level by at least one of the first TED 630 and the third TED 800, the mode detector 790 may activate a fail flag signal FFG22 to the mode signal generator 750. The mode signal generator 750 may output the mode signal MS22 with a second logic level in response to the fail flag signal FFG22 with a first logic level.

Figure 17:
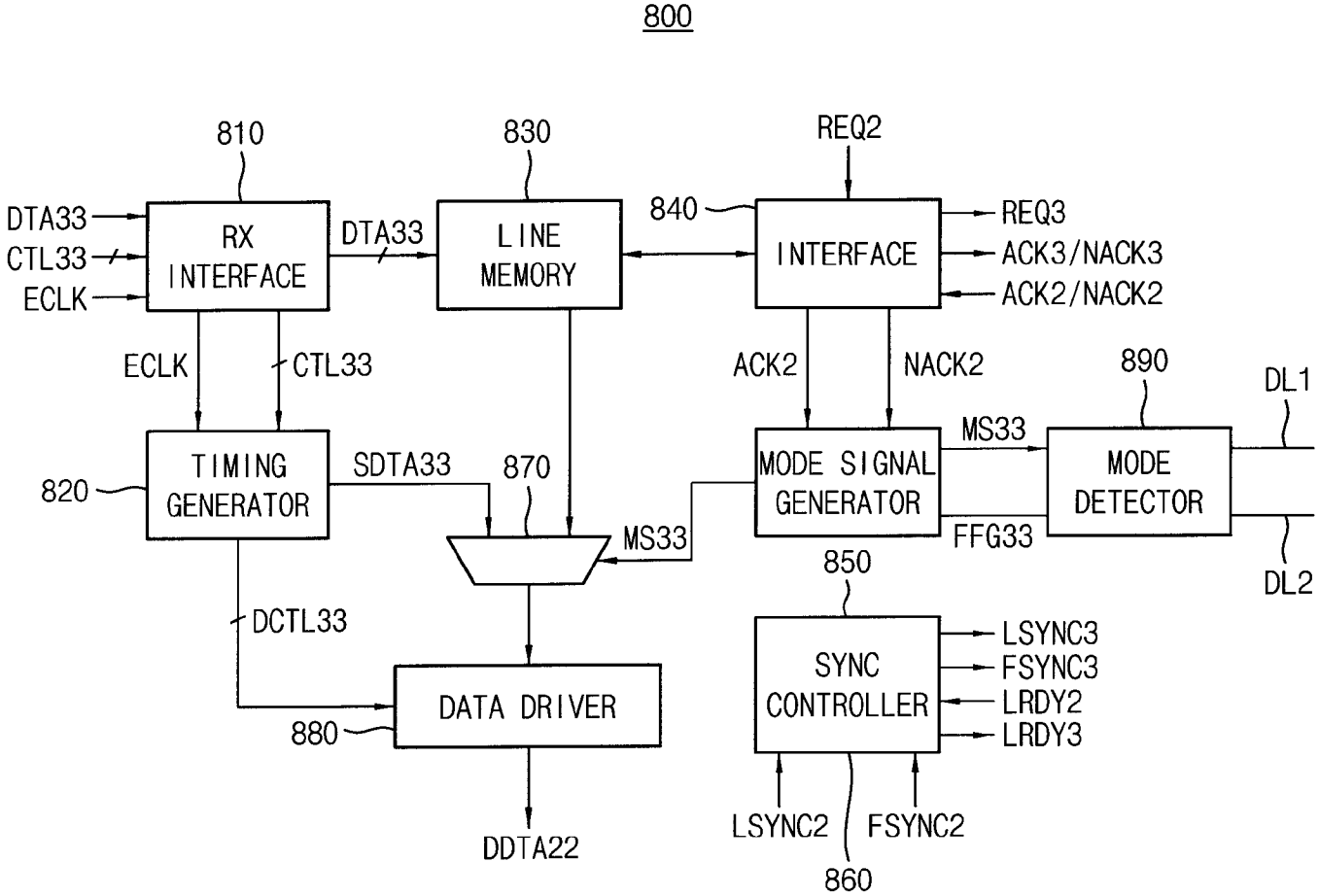
FIG. 17 is a block diagram illustrating the third TED shown in FIG. 15 according to at least one example embodiment.

FIG. 17 is a block diagram illustrating the third TED shown in FIG. 15 according to at least one example embodiment.

Referring to FIG. 17, the third TED 800 may include a reception interface 810, a timing generator 820, a line memory 830, an interface 840, a mode signal generator 850, a sync controller 860, a selection circuit 870, a data driver 880 and a mode detector 890.

The reception interface 810 may receive the third image data DTA33, the third control signal CTL33 and the external clock signal ECLK. The reception interface 810 may provide the external clock signal ECLK and the third control signal CTL33 to the timing generator 820 and may provide the third image data DTA330 to the line memory 830.

The line memory 830 may store the third image data DTA33 on an image line basis. The line memory 830 may provide the selection circuit 870 with the stored third image data DTA33 on an image line basis.

The timing generator 820 may receive the external clock signal ECLK, the third control signal CTL33 and a mode signal MS33. The timing generator 820 may generate a data control signal DCTL33 for controlling the data driver 880, based on the third control signal CTL33. The timing generator 820 may generate a third replacement image data SDTA33 to be provided to the selection circuit 870 in a fail safe mode, based on the external clock signal ECLK and the mode signal MS33.

The interface 840 may be connected to the line memory 830. When a first image line of the third image data DTA33 is stored in the line memory 830, the interface 840 may repeat the request REQ2 to transmit the request REQ3 to the fourth TED 640. The interface 840 may receive the signal ACK2/NACK2 from the fourth TED 640 and may provide the signals ACK2/NACK2 to the mode signal generator 850. In addition, the interface 840 may transmit the signals ACK3/NACK3 to the second TED 700 based on the signals ACK2/NACK2.

When the mode signal generator 850 receives the ACK signal ACK2, the mode signal generator 850 may generate the mode signal MS33 with a first logic level to the timing generator 820 and the selection circuit 870. When the mode signal generator 850 receives the NACK signal NACK2 consecutively not less than a desired reference and/or threshold number of times, the mode signal generator 850 may generate the mode signal MS33 with a second logic level to the timing generator 820, the first selection circuit 870 and the mode detector 890.

The sync controller 860 may receive the line sync signal LSYNC2 from the second TED 700 and may transmit the line sync signal LSYNC3 to the fourth TED 640 in response to the line sync signal LSYNC2. The sync controller 860 may receive the frame sync signal FSYNC2 from the second TED 700 and may transmit the frame sync signal FSYNC3 to the fourth TED 640 in response to the frame sync signal FSYNC2. When the sync controller 860 receives the line ready signal LRDY2 indicating that the replacement image data is ready in the fail safe mode, the sync controller 860 may transmit the line ready signal LRDY3 to the second TED 700.

The selection circuit 870 may include a multiplexer and may select one of the third image data DTA33 provided from the line memory 830 on an image line basis and the third replacement image data SDTA33, in response to the mode signal MS33 and may provide the selected one to the data driver 880.

The data driver 880 may provide the third display region 580 with an output of the selection circuit 870 as the third display data DDTA according to the data control signal DCTL33.

The mode detector 890 may be connected to the second TED 700 through the detection line DL1, may be connected to the fourth TED 640 through a detection line DL2 and may drive the detection lines DL1 and DL2 to a first logic level (logic high level), in response to the mode signal MS33 with a second logic level. When the mode detector 890 detects that at least one of the detection lines DL1 and DL2 is driven to a first logic level, the mode detector 890 may activate a fail flag signal FFG33 to the mode signal generator 850. The mode signal generator 850 may output the mode signal MS33 with a second logic level in response to the fail flag signal FFG33 with a first logic level.

Configurations of the first TED 630 and the fourth TED 640 may be similar to a configuration of the second TED 800 of FIG. 16 in certain example embodiments.

Figure 18:
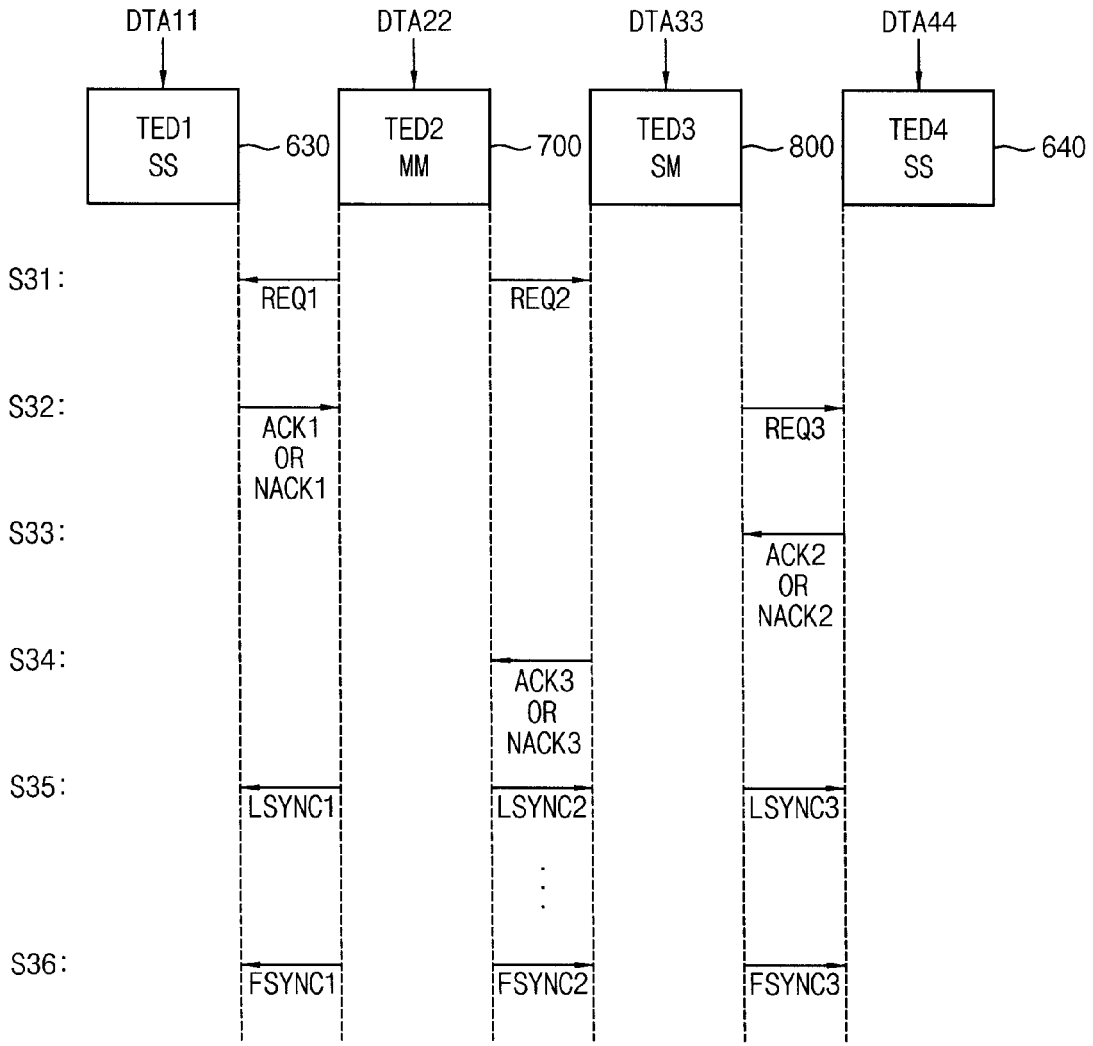
FIG. 18 illustrates signals transferred between the first through fourth TEDs in FIG. 15 in a normal display mode according to at least one example embodiment.

FIG. 18 illustrates signals transferred between the first through fourth TEDs in FIG. 15 in a normal display mode according to at least on example embodiment.

Referring to FIGS. 15 through 18, when a first image line of the second image data DTA22 is stored in the line memory 730, the second TED 700 may transmit the request REQ1 to the first TED 630 and may transmit the request REQ2 to the third TED 800 (S31).

When a first image line of the third image data DTA33 is stored in the line memory 830, the third TED 800 may repeat the request REQ2 to transmit the request REQ3 to the fourth TED 640 (S32).

In response to the request REQ3, the fourth TED 640 may transmit, to the third TED 800, the signal ACK2/NACK2 indicating whether a first image line of the fourth image data DTA44 is ready (S33), and the third TED 800 may transmit to the second TED 700 the signal ACK3/NACK3 based on the signal ACK2/NACK2 and whether a first image line of the third image data DTA33 is ready (S34).

When the second TED 700 receives both the ACK signals ACK1 and ACK3, the second TED 700 may transmit the line sync signal LSYNC1 to the first TED 630, the second TED 700 may transmit the line sync signal LSYNC2 to the third TED 800, and the third TED 800 may transmit the line sync signal LSYNC3 to the fourth TED 640 based on the line sync signal LSYNC2 (S35) such that the corresponding image lines of the first through fourth display data DDTA11~DDTA44 are displayed in synchronization with respect to each other in the first through fourth display regions 560, 570, 580 and 590.

When the display of the second display data DDTA22 on one frame is completed, the second TED 700 may transmit the frame sync signals FSYNC1 and FSYNC2 to the first TED 630 and the third TED 800 respectively and the third TED 800 may transmit the frame sync signal FSYNC3 to the fourth TED 640 based on the frame sync signal FSYNC2 (S36). Each of the frame sync signals FSYNC1, FSYNC2 and FSYNC3 may indicate that a new frame to be displayed is ready.

A timing with the third TED 800 may transmit the line sync signal LSYNC3 and the frame sync signal FSYNC3 to the fourth TED 640 may be synchronized with a timing with which the second TED 700 may transmit the line sync signal LSYNC1 and the frame sync signal FSYNC1 to the first TED 630.

Figure 19:
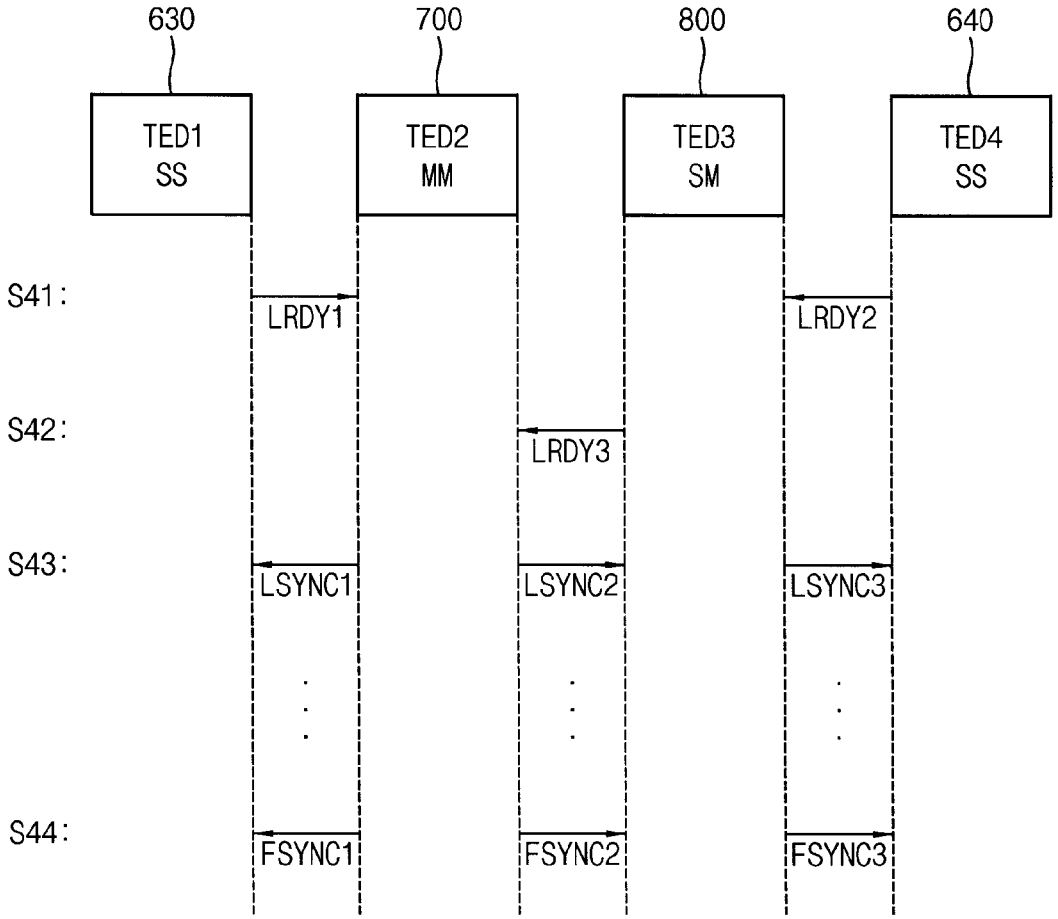
FIG. 19 illustrates signals transferred between the first through fourth TEDs in FIG. 15 in a fail safe mode according to at least one example embodiment.

FIG. 19 illustrates signals transferred between the first through fourth TEDs in FIG. 15 in a fail safe mode according to at least one example embodiment.

Referring to FIGS. 15 through 17 and 19, when the first replacement image data is ready in the fail safe mode, the first TED 630 may transmit the line ready signal LRDY1 to the second TED 700, and when the fourth replacement image data is ready in the fail safe mode, the fourth TED 640 may transmit the line ready signal LRDY2 to the third TED 800 (S41).

When the third replacement image data is ready and the third TED 800 receives the line ready signal LRDY2, the third TED 800 may transmit the line ready signal LRDY3 to the second TED 700 (S42).

When the second replacement image data is ready, in response to the line ready signals LRDY1 and LRDY3, the second TED 700 may transmit the line sync signals LSYNC1 and LSYNC2 to the first TED 630 and the third TED 800 respectively and the third TED 800 may transmit the line sync signal LSYNC3 to the fourth TED 640 based on the line sync signal LSYNC2 such that corresponding image lines of the first through fourth replacement image data are displayed in synchronization with respect to each other in the first through fourth display regions 560, 570, 580 and 590 (S43).

When the display of the second replacement image data on one frame is completed, the second TED 700 may transmit the frame sync signals FSYNC1 and FSYNC2 to the first TED 630 and the third TED 800 respectively and the third TED 800 may transmit the frame sync signal FSYNC3 to the fourth TED 640 based on the frame sync signal FSYNC2 (S44). Each of the frame sync signals FSYNC1, FSYNC2 and FSYNC3 may indicate that a new frame to be displayed is ready (S44).

Figure 20:
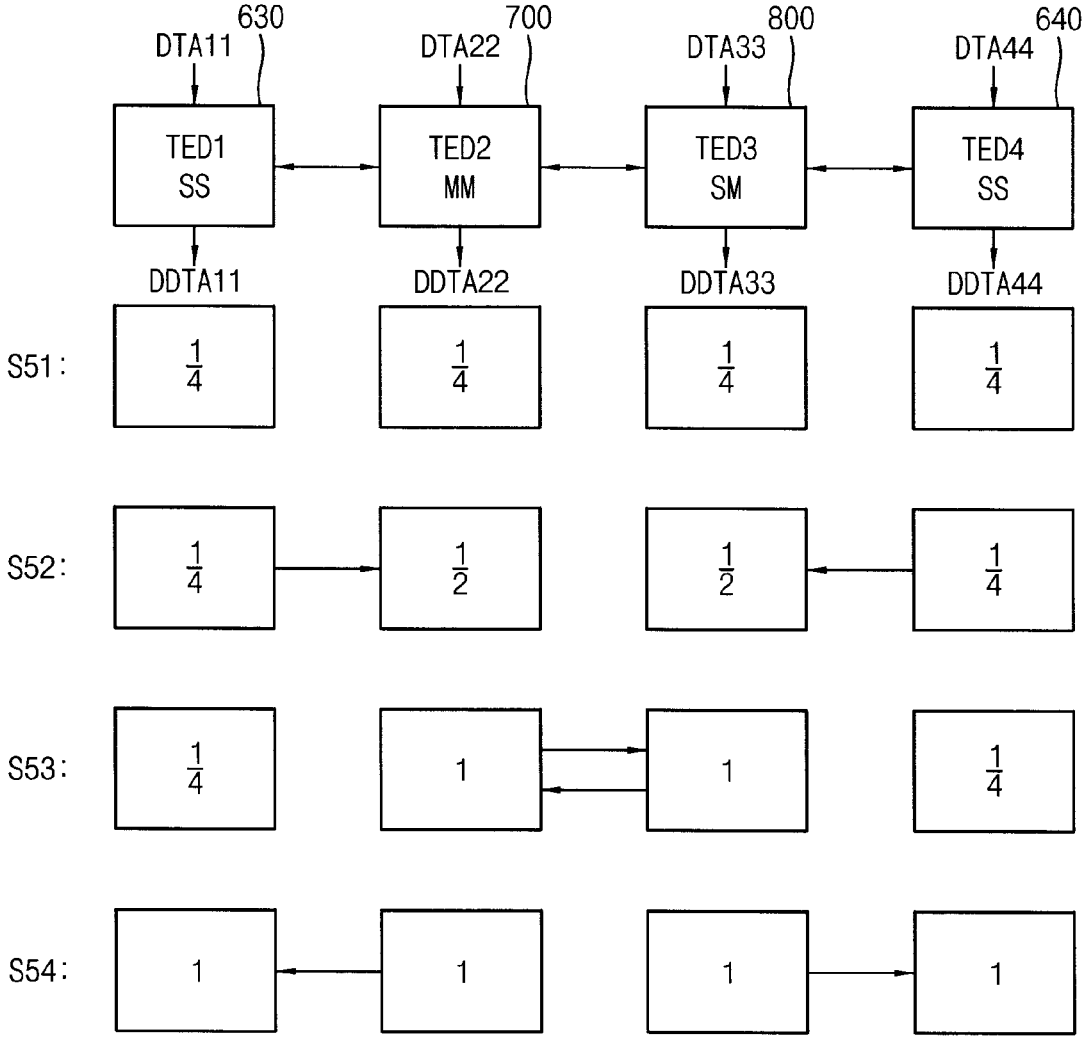
FIG. 20 illustrates that information on data is transferred between the first through fourth TEDs in FIG. 15 in the normal display mode according to at least one example embodiment.

FIG. 20 illustrates that information on data is transferred between the first through fourth TEDs in FIG. 15 in the normal display mode according to at least one example embodiment.

Figure 21:
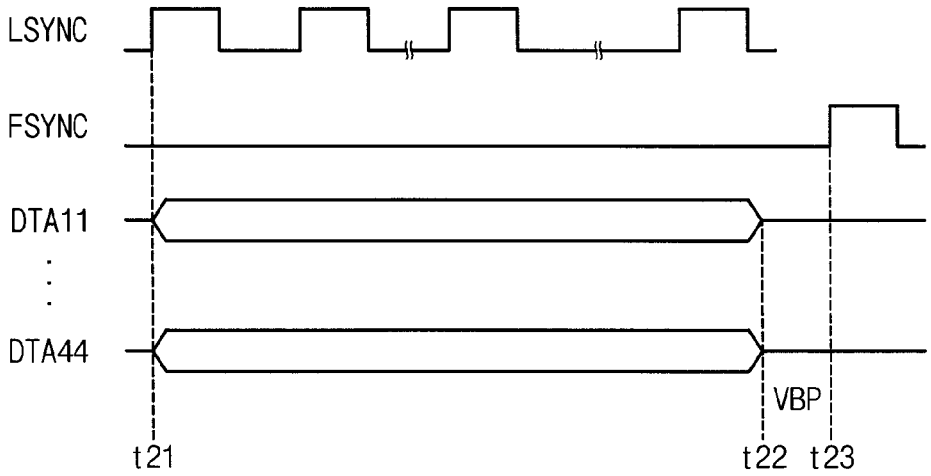
FIG. 21 is a timing diagram illustrating that information on data is transferred between the first through fourth TEDs in FIG. 15 in the normal display mode according to at least one example embodiment.

FIG. 21 is a timing diagram illustrating that information on data is transferred between the first through fourth TEDs in FIG. 15 in the normal display mode according to at least one example embodiment.

Referring to FIGS. 15, 20 and 21, while a first frame of the first through fourth image data DTA11~DTA44 is being displayed in the display panel 550 on an image line basis, in response to the line sync signal LSYNC at a time t21, each of the first through fourth TEDs 630, 700, 800, 640 may have each information on each of the first through fourth image data DTA11~DTA44 (S51). During a vertical blank period VBP between times t22 and t23, the second TED 700 may receive information on the first image data DTA11 from the first TED 630 and the third TED 800 may receive information on the fourth image data DTA44 from the fourth TED 640 (S52). At a time t23, a new frame (a second frame) starts to be displayed in response to the frame sync signal FSYNC, during a vertical blank period VBP of the second frame, the second TED 700 and the third TED 800 may exchange information on the image data and the second TED 700 and the third TED 800 may obtain all information on the first through fourth image data DTA11~DTA44 (S53). During a vertical blank period VBP of a third frame, the second TED 700 and the third TED 800 may transmit the information on the first through fourth image data DTA11~DTA44 to the first TED 630 the fourth TED 640 respectively (S54), and each of the first through fourth TEDs 630, 700, 800, 640 may obtain all the information on the first through fourth image data DTA11~DTA44.

Figure 22A:
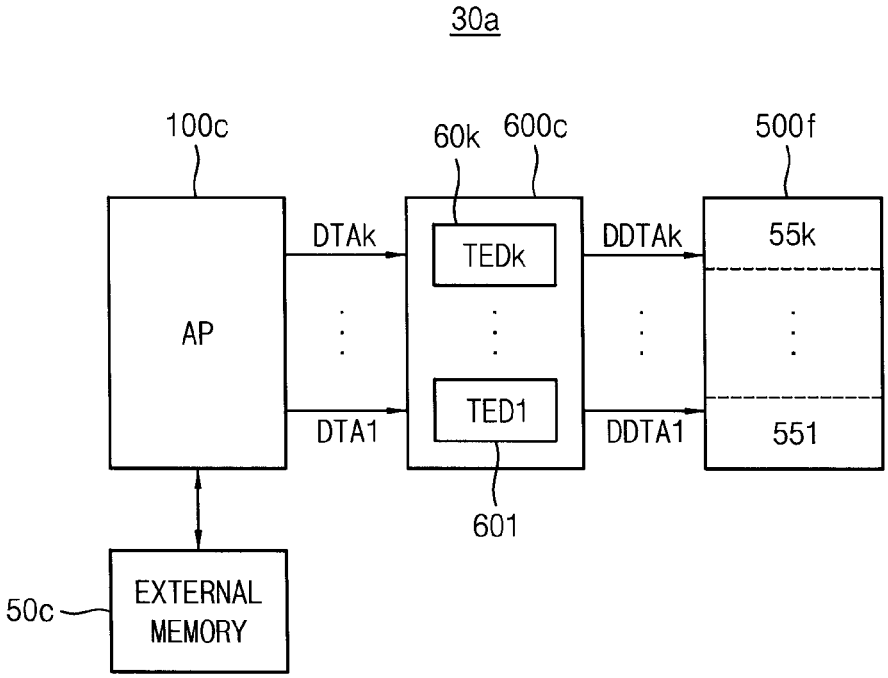
FIGS. 22A and 22B are block diagrams respectively illustrating display systems according to at least one example embodiment.
Figure 22B:
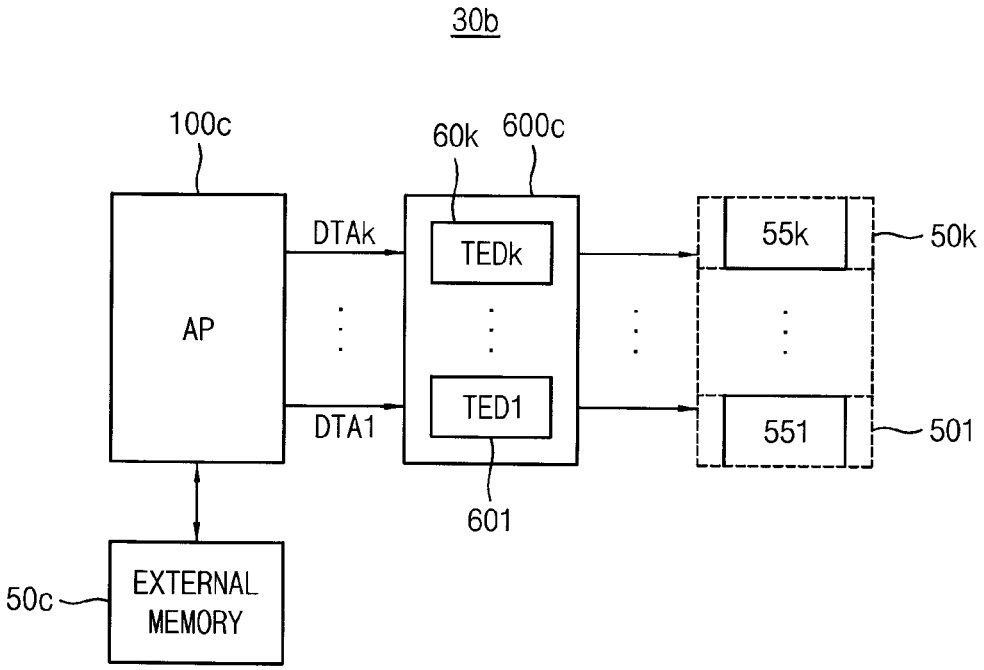

FIGS. 22A and 22B are block diagrams respectively illustrating display systems according to some example embodiment.

Referring to FIGS. 22A and 22B, a display system (or, an image data processing system) 30*a* or 30*b* may include an application processor 100*c*, an external memory 50*c*, DDI 600*c* and at least one display panel 550*f* or 501~50*k*.

The application processor 100*c* may control the external memory 50*c* and/or the DDI 600*c*. In FIG. 22A, the display panel 550*f* may include first through k-th display regions 551~55*k*. In FIG. 22B, the first through k-th display panels 501~50*k* may include the first display region 510 and the second display panel 500*c* may include the first through k-th display regions 551~55*k* respectively. The external memory 50*c* may include display data to be displayed in the first through k-th display regions 551~55*k*.

The application processor 100*c* may provide the DDI 600*c* with first through k-th image data DTA1~DTAk and control signals associated with the first through k-th image data DTA1~DTAk.

The DDI 600*c* may include first through k-th TEDs 601~60*k*, and each of the first through k-th TEDs 601~60*k* may process the first through k-th image data DTA1~DTAk to provide each of first through k-th display data DDTA1~DDTAk to each of the first through k-th display regions 551~55*k*.

According to an example embodiment, one or more of the first through k-th TEDs 601~60*k* may operate as a master TED and the master TED may control the other TEDs directly or indirectly and may control the display timings of the first through k-th display data DDTA1~DDTAk such that corresponding image lines of the first through k-th display data DDTA1~DDTAk are displayed in synchronization with respect to each other in the first through k-th display regions 551~55*k*. According to other example embodiments, the first through k-th TEDs may operate in a peer-to-peer manner, or other like command manner.

Figure 23:
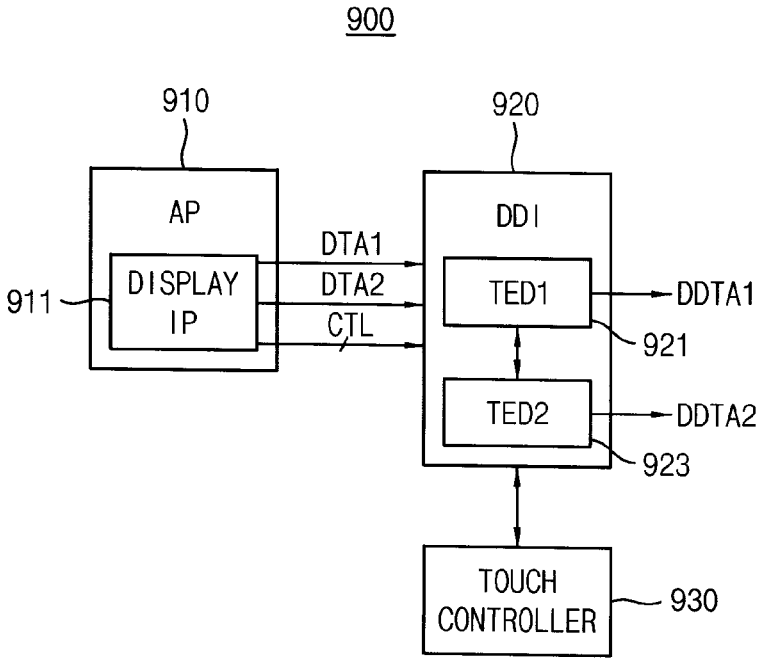
FIG. 23 is a block diagram illustrating a display system according to at least one example embodiment.

FIG. 23 is a block diagram illustrating a display system according to at least one example embodiment.

Referring to FIG. 23, a display system 900 may include an application processor 910, a DDI 920 and a touch controller 930.

The application processor 910 may include a display intellectual property (IP) block 911, and the display IP block 911 may provide the DDI 920 with a first image data DTA1, a second image data DTA2 and control signals CTL.

The DDI 920 may be directly connected to the touch controller 930, and may include at least a first TED 921 and a second TED 923. The first TED 921 may process the first image data DTA1 to generate a first display data DDTA1 and the second TED 923 may process the second image data DTA2 to generate a second display data DDTA2. The first TED 921 may control display timing of the first display data DDTA1 and the second display data DDTA2 using a sync signal.

Figure 24:
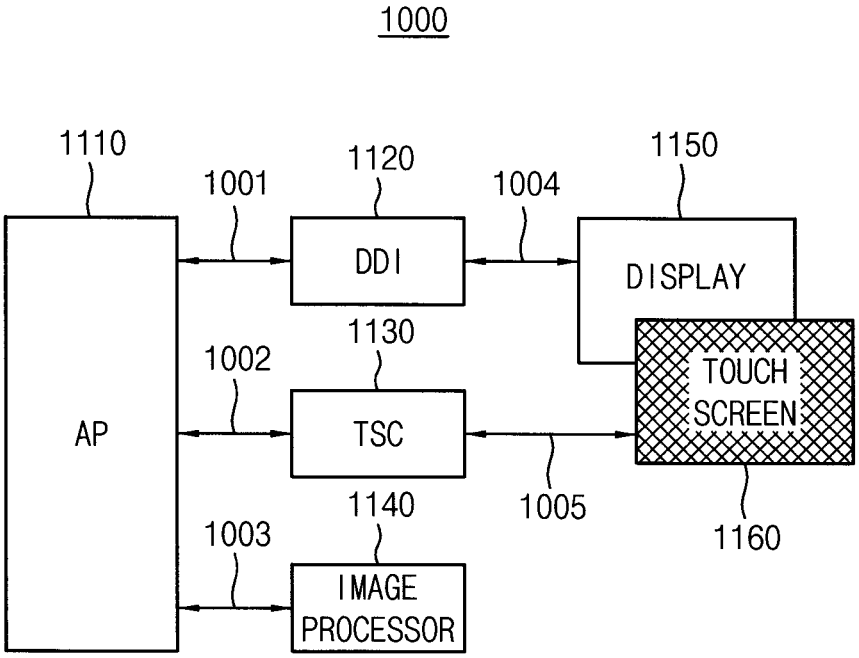
FIG. 24 is a block diagram illustrating a data processing system according to at least one example embodiment.

FIG. 24 is a block diagram illustrating a data processing system according to at least one example embodiment.

Referring to FIG. 24, a data processing system 1000 may include an application processor 1110, a DDI 1120, a touch screen controller (TSC) 1130, and an image processor 1140.

The DDI 1120 may be connected to the application processor 1110 through a bus 1001, the TSC 1130 may be connected to the application processor 1110 through a bus 1002, and the image processor 1140 may be connected to the application processor 1110 through a bus 1003.

The DDI 1120 may be operatively connected to provide display data 1004 to a display panel 1150 and TSC 1130 may be operatively connected to a touch panel 1160 overlaying the display 1150 and may be configured to receive sensor data 1005 from the touch panel 1160.

The DDI 1120 may employ one of the DDI 200 of FIG. 3, the DDI 600 of FIG. 15 and the DDI 600*c* in FIG. 22A. Therefore, the DDI 1120 may include at least a first TED and a second TED. The first TED may process a first image data to generate a first display data and the second TED may process a second image data to generate a second display data. According to an example embodiment, one of the first TED and the second TED, which may operate as a master, may control the display timing of the first display data and the second display data such that corresponding image lines of the first and second display data are displayed in synchronization with respect to each other in the display panel 1150. According to an example embodiment, the first TED and the second TED may operate in a peer-to-peer manner, or any other command manner.

Figure 25:
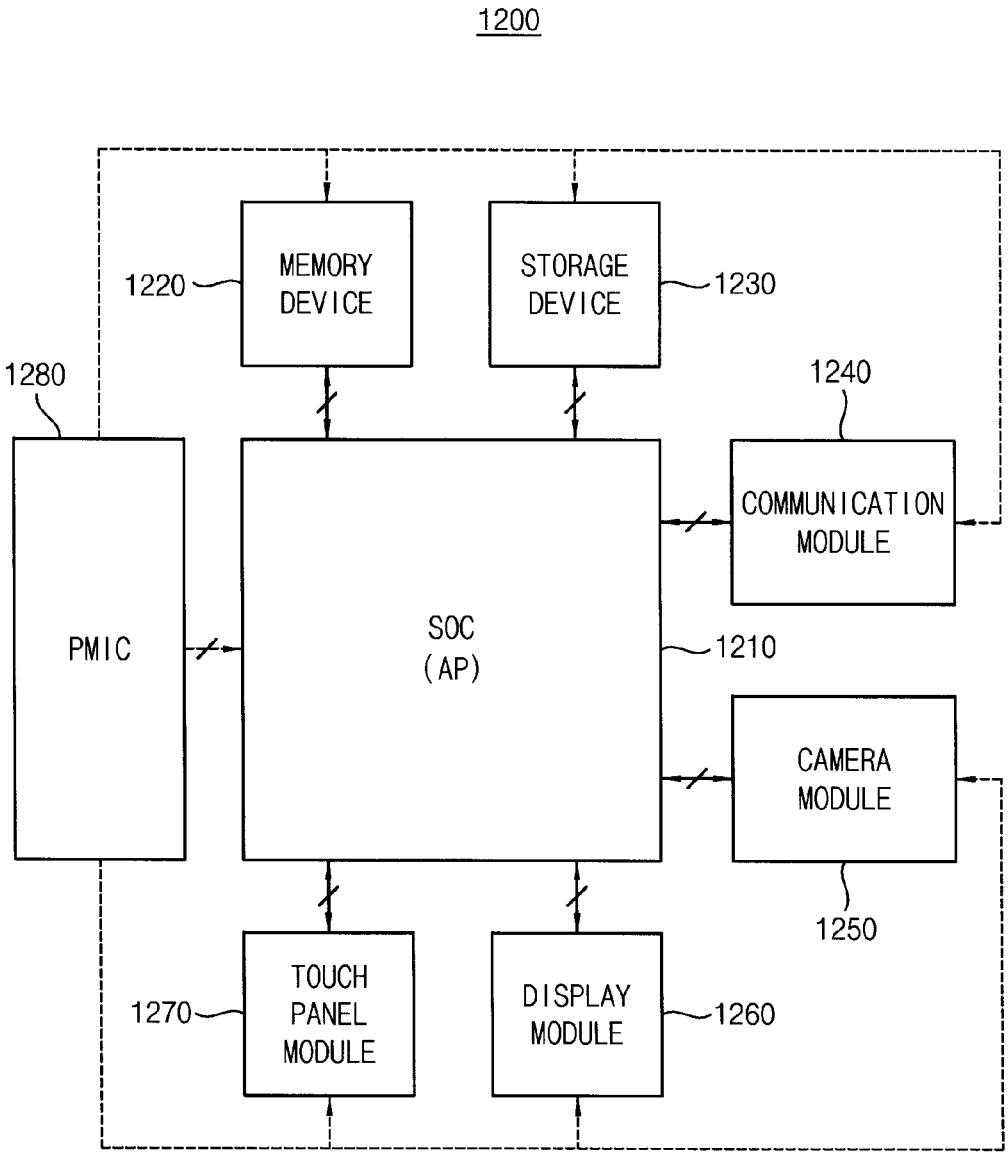
FIG. 25 is a block diagram illustrating a mobile device according to at least one example embodiment.
Figure 26:
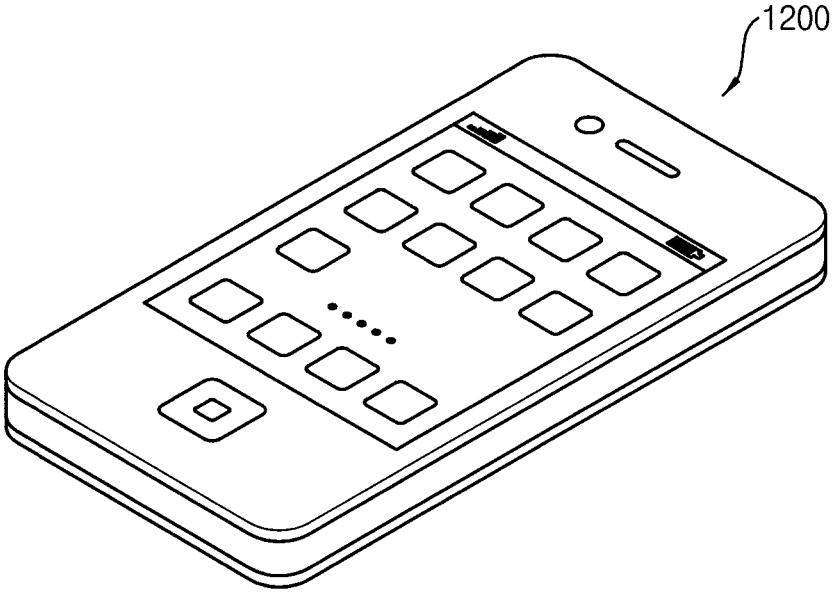
FIG. 26 is a diagram illustrating an example in which the mobile device of FIG. 25 is implemented as a smart-phone according to at least one example embodiment.

FIG. 25 is a block diagram illustrating a mobile device according to at least one example embodiments, and FIG. 26 is a diagram illustrating an example in which the mobile device of FIG. 25 is implemented as a smart-phone according to an example embodiment.

Referring to FIGS. 25 and 26, a mobile device 1200 may include a system on-chip 1210, a memory device 1220, a storage device 1230, a plurality of function modules 1240, 1250, 1260, and 1270, and a power management integrated circuit 1280. The power management integrated circuit 1280 may provide an operating voltage to the system on-chip 1210, the memory device 1220, the storage device 1230, and the function modules 1240, 1250, 1260, and 1270, respectively. As illustrated in FIG. 26, the mobile device 1200 may be implemented as a smart-phone, and the system on-chip 1210 may correspond to an application processor (AP). Although it is illustrated in FIG. 25 that the power management integrated circuit 1280 is disposed outside the system on-chip 1210, the power management integrated circuit 1280 may be placed inside the system on-chip 1210.

The application processor 1210 may control an overall operation of the mobile device 1200. That is, the application processor 1210 may control the memory device 1220, the storage device 1230, and the function modules 1240, 1250, 1260, and 1270. Here, the application processor 1210 may monitor an operating state or an operating condition of a central processing unit (CPU) included in the application processor 1210, and may perform a dynamic voltage and frequency scaling (DVFS) (i.e., increase, decrease, or maintain an operating frequency of the central processing unit) based on the monitored operating condition of the central processing unit. In example embodiments, the DVFS may be performed by hardware or software.

The memory device 1220 and the storage device 1230 may store data for operations of the mobile device 1200. In some example embodiments, the memory device 1220 and the storage device 1230 may be included in the application processor 1210. For example, the memory device 1220 may include a volatile semiconductor memory device such as a dynamic random access memory (DRAM) device, a static random access memory (SRAM) device, a mobile DRAM, etc. In addition, the storage device 1230 may include a non-volatile semiconductor memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc. In some example embodiments, the storage device 1230 may further include a solid state drive (SSD), a hard disk drive (HDD), a CD-ROM, etc. However, kinds of the memory device 1220 and the storage device 1230 are not limited thereto.

The function modules 1240, 1250, 1260, and 1270 may perform various functions of the mobile device 1200. For example, the mobile device 1200 may include a communication module 1240 that performs a communication function (e.g., a code division multiple access (CDMA) module, a long term evolution (LTE) module, a radio frequency (RF) module, an ultra wideband (UWB) module, a wireless local area network (WLAN) module, a worldwide interoperability for microwave access (WIMAX) module, etc.), a camera module 1250 that performs a camera function, a display module 1260 that performs a display function, a touch panel module 1270 that performs a touch-input sensing function, etc. The display module 1260 may include the above-described DDI and a display panel. Therefore, the display module 1260 may include at least a first TED and a second TED. The first TED may process a first image data to generate a first display data and the second TED may process a second image data to generate a second display data. One of the first TED and the second TED, which may operate as a master, may control the display timing of the first display data and the second display data such that corresponding image lines of the first and second display data are displayed in synchronization with respect to each other in the display panel. According to an example embodiment, the first TED and the second TED may operate in a peer-to-peer manner, or any other command manner.

In some example embodiments, the mobile device 1200 may further include a global positioning system (GPS) module, a microphone (MIC) module, a speaker module, various sensor modules (e.g., a gyroscope sensor, a geomagnetic sensor, an acceleration sensor, a gravity sensor, an illumination sensor, a proximity sensor, a digital compass, etc.). However, the type of the function modules 1240, 1250, 1260, and 1270 included in the mobile device 1200 are not limited thereto.

The elements illustrated in FIG. 25 may be implemented with various packaging schemes. For example, at least some elements may be implemented using Package on Package (PoP), Ball grid arrays (BGAs), Chip scale packages (CSPs), Plastic Leaded Chip Carrier (PLCC), Plastic Dual In-Line Package (PDIP), Die in Waffle Pack, Die in Wafer Form, Chip On Board (COB), Ceramic Dual In-Line Package (CERDIP), Plastic Metric Quad Flat Pack (MQFP), Thin Quad Flatpack (TQFP), Small Outline (SOIC), Shrink Small Outline Package (SSOP), Thin Small Outline (TSOP), Thin Quad Flatpack (TQFP), System In Package (SIP), Multi Chip Package (MCP), Wafer-level Fabricated Package (WFP), Wafer-Level Processed Stack Package (WSP), etc.

Figure 27:
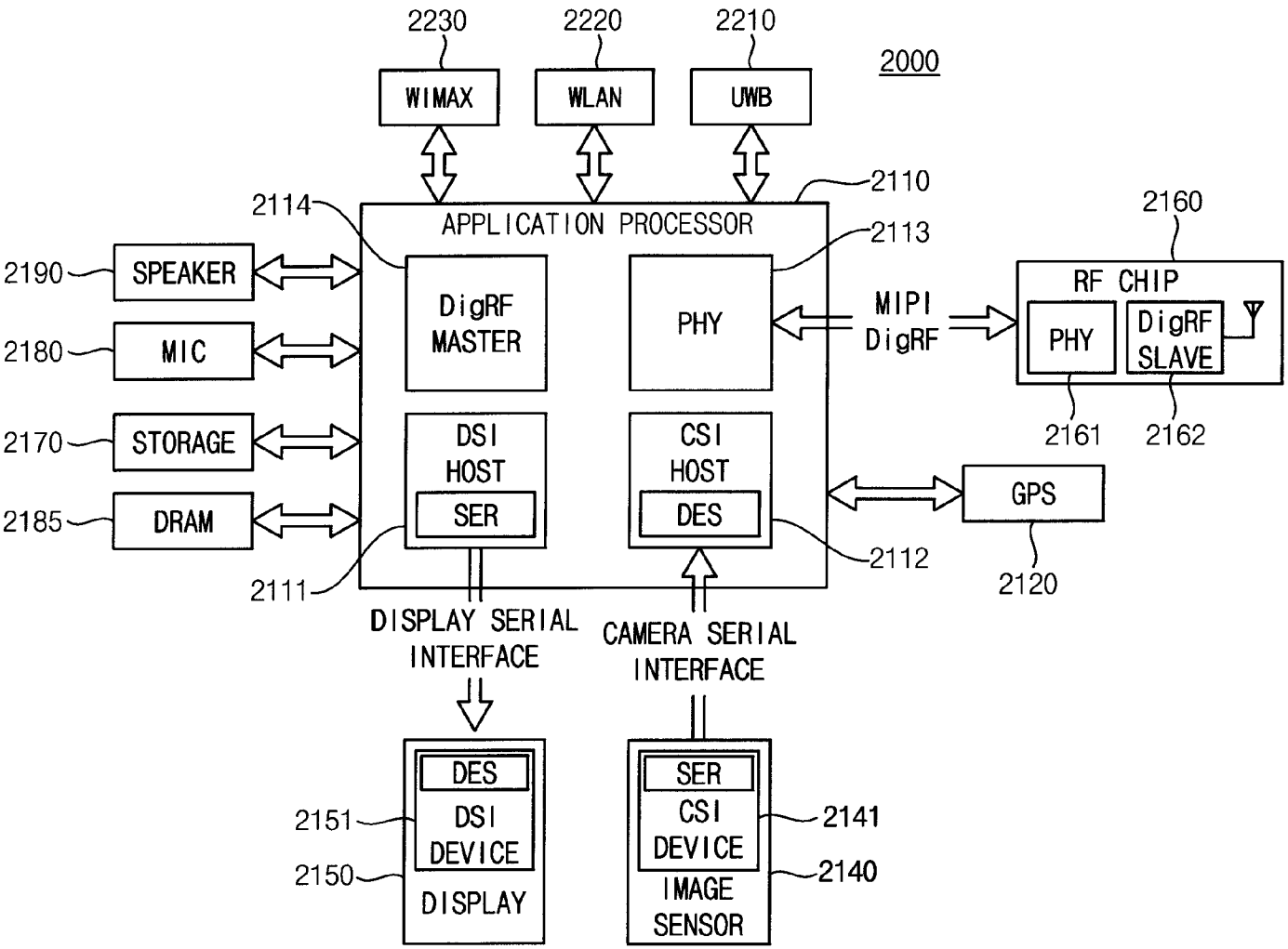
FIG. 27 is a block diagram illustrating an example of an interface used in the mobile device according to at least one example embodiment.

FIG. 27 is a block diagram illustrating an example of an interface used in the mobile device according to at least one example embodiment.

Referring to FIG. 27, the mobile device 2000 may be implemented as a data processing device (for instance, a portable phone, a personal digital assistant, a portable multimedia player, or a smart phone) that uses or supports an MIPI interface, and may include an application processor 2110, an image sensor 2140 and a display 2150.

A CSI host 2112 of the application processor 2110 can make serial communication with a CSI device 2141 of the image sensor 2140 through a camera serial interface (CSI). In one example embodiment, the CSI host 2112 may include an optical serializer DES and the CSI device 2141 may include an optical serializer SER. A DSI host 2111 of the application processor 2110 can make serial communication with a DSI device 2151 of the display 2150 through a display serial interface (DSI). In one example embodiment, the DSI host 2111 may include an optical serializer SER and the DSI device 2151 may include an optical serializer DES.

In addition, the mobile device 2000 may further include an RF (radio frequency) chip 2160 which can make communication with the application processor 2110. Data may be transceived between a PHY 2113 of the mobile device 2000 and a PHY 2161 of the RF chip 2160 according to the MIPI (Mobile Industry Processor Interface) DigRF. In addition, the application processor 2110 may further include a DigRF MASTER 2114 to control data transmission according to the MIPI DigRF and the RF chip 2160 may further include a DigRF SLAVE 2162 which is controlled by the DigRF MASTER 2114.

Meanwhile, the mobile device 2000 may include a GPS (Global Positioning System) 2120, a storage 2170, a microphone 2180, a DRAM (Dynamic Random Access Memory) 2185 and a speaker 2190. In addition, the mobile device 2000 may communicate over a network using a UWB (Ultra WideBand) 2210, a WLAN (Wireless Local Area Network) 2220, a WIMAX (Worldwide Interoperability for Microwave Access) 2230, or other communication and/or data networks. The structure and the interface of the mobile device 2000 are illustrative purposes only and example embodiments may not be limited thereto.

The inventive concepts may be applied to a mobile phone, a smart phone, a personal digital assistant (PDA), a portable multimedia player (PMP), a digital camera, a camcoder, a personal computer, a server computer, a workstation, a laptop, a digital television, a set-top box, a music player, a portable game console, a navigation system, etc.

The units and/or modules described herein may be implemented using hardware components, software components, or a combination thereof. For example, the hardware components may include microcontrollers, memory modules, sensors, amplifiers, band-pass filters, analog to digital converters, and processing devices, etc. A processing device may be implemented using one or more hardware device configured to carry out and/or execute program code by performing arithmetical, logical, and input/output operations. The processing device(s) may include a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such as parallel processors, multi-core processors, distributed processing, etc.

The software may include a computer program, a piece of code, an instruction, or some combination thereof, to independently or collectively instruct and/or configure the processing device to operate as desired, thereby transforming the processing device into a special purpose processor. Software and data may be embodied permanently or temporarily in any type of machine, component, physical or virtual equipment, or computer storage medium or device. The software also may be distributed over network coupled computer systems so that the software is stored and executed in a distributed fashion. The software and data may be stored by one or more non-transitory computer readable recording mediums.

The methods according to the above-described example embodiments may be recorded in non-transitory computer-readable media including program instructions to implement various operations of the above-described example embodiments. The media may also include, alone or in combination with the program instructions, data files, data structures, etc. The program instructions recorded on the media may be those specially designed and constructed for the purposes of some example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

It should be understood that example embodiments described herein should be considered in a descriptive sense only and not for purposes of limitation. Descriptions of features or aspects within each device or method according to example embodiments should typically be considered as available for other similar features or aspects in other devices or methods according to example embodiments. While some example embodiments have been particularly shown and described, it will be understood by one of ordinary skill in the art that variations in form and detail may be made therein without departing from the spirit and scope of the claims.

What is claimed is:

1. A display device comprising:

at least one display panel including a first display region and a second display region; and a display driver integrated circuit (DDI) including a first timing controller-embedded driver (TED) and a second TED, wherein the first TED is configured to process first image data to provide first display data to the first display region, the second TED is configured to process second image data to provide second display data to the second display region, the first TED is configured to control display timings of the first display data and the second display data, and the first TED includes, a first interface configured to transmit a request to the second TED when a first primary image line corresponding to a first image line of the first image data is stored in the first TED and the first interface is configured to receive a response to the request from the second TED, a first synchronization controller configured to receive an acknowledge (ACK) signal as the response from the second TED and further configured to transmit a line synchronization (sync) signal to the second TED in response to the ACK signal, and wherein the first TED is further configured to transmit a frame sync signal to the second TED after the first TED transmits a last image line of the first image data to the first display region and the frame sync signal indicates that a next frame is to be displayed.

2. The display device of claim 1, wherein the first display data and the second display data constitute a frame that is displayed in the first display region and the second display region.

3. The display device of claim 1, wherein the first TED is configured to transmit the line synchronization (sync) signal to the second TED such that the first display data and the second display data are displayed in synchronization with respect to each other in the at least one display panel.

4. The display device of claim 3, wherein the first TED is configured to transmit the request to the second TED when a first primary image line corresponding to a first image line of the first image data is ready; and the second TED is configured to transmit the response to the first TED indicating whether a first secondary image line corresponding to the first primary image line and corresponding to a first image line of the second image data is ready, in response to the request.

5. The display device of claim 4, wherein the second TED is configured to transmit the acknowledge (ACK) signal as the response to the first TED when the first secondary image line of the second image data is ready.

6. The display device of claim 5, wherein the first TED is configured to display the first primary image line in the first display region in synchronization with transmitting the line sync signal to the second TED; and the second TED is configured to display the first secondary image line in the second display region in synchronization with the line sync signal.

7. The display device of claim 4, wherein the second TED is configured to transmit a negative acknowledge (NACK) signal as the response to the first TED when the first secondary image line of the second image data is not ready.

8. The display device of claim 7, wherein the first TED is configured to transmit the request to the second TED when a second primary image line of the first image data, consecutive to the first primary image line, after the first TED receives the NACK signal; and the second TED is configured to transmit a response to the first TED indicating whether a second secondary image line of the second image data, corresponding to the second primary image line, is ready.

9. The display device of claim 7, wherein the first TED is configured to drive a detection line connected to the second TED to a first logic level such that a first replacement image data and a second replacement image data are respectively displayed in the first display region and the second display region when the first TED receives the NACK signal from the second TED consecutively not less than a desired number of times.

10. The display device of claim 1, wherein the first TED comprises:

a first reception interface configured to receive the first image data, a first control signal associated with the first image data and an external clock signal;

a first line memory configured to receive the first image data from the first reception interface and configured to store the first image data on an image line basis;

a first mode signal generator configured to generate a first mode signal at least based on the ACK signal;

a first timing generator configured to generate a first data control signal, a first gate control signal and a first replacement image data based on the external clock signal, the first control signal and the first mode signal;

a first selection circuit configured to select one of the first replacement image data and an output of the first line memory in response to the first mode signal;

a first data driver configured to provide an output of the first selection circuit as the first display data to the first display region in response to the first data control signal; and a first mode detector configured to drive a detection line connected to the second TED to a first logic level when the first mode signal is a second logic level and configured to provide a first fail flag signal to the first mode signal generator in response to detecting the detection line driven to the first logic level.

11. The display device of claim 10, wherein the first timing generator comprises:

a clock generator configured to generate an internal clock signal in response to the external clock signal;

a signal generator configured to generate the first data control signal and the first gate control signal in response to the first control signal; and a register configured to output a stored image data therein as the first replacement image data in response to the first mode signal and the internal clock signal.

12. The display device of claim 10, wherein the first mode signal generator is configured to:

output the first mode signal with a first logic level when the first mode signal generator receives the ACK signal;

output the first mode signal with a second logic level when the first mode signal generator receives a negative acknowledge (NACK) signal indicating that an image line of the second image data from the first interface consecutively not less than a desired number of times; and output the first mode signal with a first logic level in response to the first fail flag signal.

13. A display driver integrated circuit (DDI), comprising:

a plurality of timing controller-embedded drivers (TED)s, the plurality of TEDs configured to process a plurality of image data to provide a plurality of display data to a plurality of display regions, respectively;

at least one of the plurality of TEDs is configured to operate as a master; and the at least one master TED is configured to, control display timings of at least one of the other plurality of TEDs, and the at least one master TED includes, a first interface configured to transmit a request to at least one of the other plurality of TEDs when a first primary image line corresponding to a first image line of first image data is stored in the at least one master TED and the first interface is configured to receive a response to the request from the at least one of the other TEDs, and a first synchronization controller configured to receive an acknowledge (ACK) signal as the response from the at least one of the other TEDs and further configured to transmit a line synchronization (sync) signal to the at least one of the other TEDs in response to the ACK signal, and wherein the at least one master TED is further configured to transmit a frame sync signal to the at least one other TED after the at least one master TED transmits a last image line of the first image data to a first display region of the plurality of display regions and the frame sync signal indicates that a next frame is to be displayed.

14. The DDI of claim 13, wherein the at least one master TED is configured to transmit the line sync signal to at least one of the other plurality of TEDs such that corresponding image lines of the plurality of display data are displayed in synchronization with respect to each other in the plurality of display regions.

15. The DDI of claim 13, wherein the plurality of TEDs comprises:

a first TED configured to operate as the master TED; and a second TED configured to operate as a slave and configured to display corresponding display data in accordance with signals from the first TED.

16. A display device, comprising:

at least one display panel, the at least one display panel including at least one display region; and at least one display driver integrated circuit (DDI), the DDI including, a plurality of timing controller-embedded drivers (TED), the plurality of TEDs configured to process image data, at least one of the plurality of TEDs is configured to manage the plurality of TEDs, and the at least one managing TED is configured to synchronize display timing of the processed image data, the at least one managing TED including, a first interface configured to transmit a request to at least one of the other plurality of TEDs when a first primary image line corresponding to a first image line of first image data is stored in the at least one managing TED and the first interface is configured to receive a response to the request from the at least one of the other TEDs, and a first synchronization controller configured to receive an acknowledge (ACK) signal as the response from the at least one of the other TEDs and further configured to transmit a line synchronization (sync)

signal to the at least one of the other TEDs in response to the ACK signal; and the at least one display panel is configured to display the processed image data in the at least one display region, and wherein the at least one managing TED is further configured to transmit a frame sync signal to the at least one other TED after the at least one managing TED transmits a last image line of the first image data to the at least one display region and the frame sync signal indicates that a next frame is to be displayed.

17. The display device of claim 16, wherein the at least one display panel includes a plurality of display regions and each of the plurality of display regions is configured to display the processed image data associated with the plurality of TEDs.

18. The display device of claim 16, wherein the display timing of the processed image data is synchronized in accordance with the line sync signal transmitted by the at least one managing TED to the plurality of TEDs.

19. The display device of claim 16, wherein the at least one display panel is configured to display a replacement image in the at least one display region when a failure is detected in at least one of the plurality of TEDs.

* * * * *